US006427016B1

(12) United States Patent
Azima et al.

(10) Patent No.: US 6,427,016 B1
(45) Date of Patent: Jul. 30, 2002

(54) ACOUSTIC DEVICES

(75) Inventors: Henry Azima; Neil Harris, both of Cambridge; Bijan Djahansouzi, London, all of (GB)

(73) Assignee: New Transducers Limited, London (GB)

( * ) Notice: Subject to any disclaimer, the term of this patent is extended or adjusted under 35 U.S.C. 154(b) by 0 days.

(21) Appl. No.: 09/246,967

(22) Filed: Feb. 9, 1999

(30) Foreign Application Priority Data

Feb. 10, 1998 (GB) ..... 9802671
Jul. 30, 1998 (GB) ..... 9816469

(51) Int. Cl.[7] ..... H04R 25/00

(52) U.S. Cl. ..... 381/152; 381/162; 381/386; 381/395; 381/398; 381/431; 181/171; 181/173

(58) Field of Search ..... 381/152, 162, 381/163, 386, 388, 395, 398, 423, 431; 181/171, 172, 173

(56) References Cited

U.S. PATENT DOCUMENTS 3,247,925 A 4/1966 Warnaka ..... 181/31
3,347,335 A 10/1967 Watters et al. ..... 181/0.5
3,509,290 A * 4/1970 Mochida

FOREIGN PATENT DOCUMENTS

WO WO 92/03024 2/1992
WO WO 97/09842 3/1997

* cited by examiner

*Primary Examiner*—Curtis Kuntz
*Assistant Examiner*—Dionne Harvey
(74) *Attorney, Agent, or Firm*—Foley & Lardner

(57) ABSTRACT

Acoustic devices rely on bending wave action in a panel member, particularly distribution of resonant modes of such bending wave action and related acoustically significant surface vibration over area of said panel member favourable to desired or at least acceptable acoustic device performance. The devices comply with selecting parameters of said panel member affecting said distribution, including configuration/geometry and/or bending stiffness(es), and/or location(s) of bending wave transducer(s) in said area of said panel member; the selecting being in accordance with analytical assessment of power transfer related characteristic(s) of said panel member thus said acoustic device concerned and desiderata therefor correlating with achieving said acoustic device performance.

21 Claims, 21 Drawing Sheets

$\zeta = 10 \cdot \%$ $\xi 0 = 0.441$ $\eta 0 = 0.414$ $\zeta = 10 \cdot \%$ $\xi 0 = 0.437$ $\eta 0 = 0.414$ $\zeta = 10 \cdot \%$ $\xi 0 = 0.409$ $\eta 0 = 0.439$ $\zeta = 10 \cdot \%$ $\xi 0 = 0.385$ $\eta 0 = 0.387$

ACOUSTIC DEVICES

FIELD OF THE INVENTION

This invention relates to acoustic devices capable of acoustic action involving bending waves.

BACKGROUND TO THE INVENTION

Co-pending International Patent Application PCT/GB96/02145 (published W097/09842) includes various teaching as to nature, structure and configuration of acoustic panel members having capability to sustain and propagate input vibrational energy through bending waves in operative area (s) extending transversely of thickness usually (if not necessarily) to edges of the member(s). Detail analyses are made of various specific panel member configurations, with or without directional anisotropy of bending stiffness across said area(s), so as to have resonant mode vibration components distributed over said area(s) beneficially for acoustic coupling with ambient air. Analyses extend to predetermined preferential location(s) within said area(s) for transducer means, particularly operationally active or moving part(s) thereof effective in relation to acoustic vibrational activity in said area(s) and signals, usually electrical, corresponding to acoustic content of such vibrational activity. Uses are also envisaged in the above PCT application for such members as or in "passive" acoustic devices, i.e. without transducer means, such as for reverberation or for acoustic filtering or for acoustically "voicing" a space or room. Other "active" acoustic devices, i.e. with bending wave transducer means, include a remarkably wide range of loudspeakers as sources of sound when supplied with input signals to be converted to said sound, and also in such as microphones when exposed to sound to be converted into other signals.

Co-pending International Patent Application PCT/GB98/00621 concerns applying to panel member(s) distribution(s) of stiffness(es) and/or mass(es) not centred coincidentally with centre(s) of mass and/or geometrical centre(s) . This is particularly (but not exclusively) useful to beneficially combining both pistonic acoustic action (as for hitherto conventional, typically cone-type, loudspeakers) with bending wave acoustic action generally as in the above published PCT application. Specifically, location(s) of transducer means for both pistonic and bending wave actions can include at centre(s) of mass and/or geometrical centre(s) (as very much suits pistonic action), but still satisfy general desiderata for bending wave action.

This invention has arisen from intuitive feeling that various approaches of the above PCT applications to design and specification of acoustically useful bending wave action members reflect some other useful concept/methodology that should be capable of yielding as good or yet better and/or as practical or more practical design/specification criteria, perhaps including other useful configurations and transducer locations not before specified or otherwise appreciated. It has been an object of this invention to investigate, and arrive at such results.

SUMMARY OF THE INVENTION

According to first general method and device aspects of this invention, panel member parameters affecting bending wave action, such as particularly configuration/geometry in relation to bending stiffness(es) and/or bending wave transducer location(s), is/are in accordance with desiderata applied to analysable characteristic(s) relevant to power transfer for the acoustic device concerned, such desiderata usefully favouring acceptable distribution and/or density and/or evenness of excitation of acoustically relevant resonant modes of surface vibration involved in bending wave action.

It has been particularly established that desirably effective resonant mode density/distribution correlates with a measure of smoothness of power transfer for the acoustic device concerned; and use and results of such correlation in terms of acoustic panel members involving bending wave action constitute various other aspects of this invention.

Underlying inventive rationale or concept involved includes appreciation that, for active acoustic devices as sources of sound, satisfactory acoustic performance of panel members concerned is more dependent on smoothness of power output than on hitherto conventionally esteemed flatness of output over whatever frequency range is concerned/desired. Deviation from flatness of output is actually readily compensated by suitable electronic signal conditioning, specifically so long as the output deviations concerned are reasonably smooth.

Energy losses within panel members and transducer means of acoustic devices concerned tend to be both relatively small and reasonably smooth in themselves. Accordingly, for the purposes hereof, effectiveness of device design and specification can be based on smoothness of input power transfer, including particularly as to geometry/configuration such as aspect ratios and as to bending wave transducer location(s) such as in terms of proportionate co-ordinates.

Whatever particular characteristic(s) is/are involved in assessing smoothness of power transfer, conveniently and preferentially input power transfer, it is practical to be concerned with deviation from some useful condition, state or value, whether of arbitrary or of relational nature. Thus, analysis relative to same or unity weighting of whatever resonant frequency modes are concerned has produced useful results, as has analysis relative to mean value(s) . However, selective adjustment of weighting etc is also seen as useful refinement, for example at least for end-most modal frequencies involved, particularly lowest; and feasibly more generally or otherwise.

The frequency modes concerned/involved in analytical assessment hereof can be as arise from making practically viable simplification, such as using analogies of one-dimensional nature, say to orthogonal beams notionally in directions parallel to pairs of opposite sides of substantially rectangular panel members. This simplification approach reflects success achieved in specific teaching of W097/09842, including first consideration relative to a number of resonant modes in each beam direction and directly related inter-active modes. Refinements of analyses relative to two-dimensional relationships should more closely reflect realities of panel members as such, including revealing and taking appropriate account of more inter-actively related resonant modal frequencies.

Preferred said characteristic(s) relevant to power transfer for the panel member include criteria for mechanical impedance, say as to standard deviation with application of a smoothing factor, say 10%.

In some particular inventive aspects hereof, criteria for mechanical impedance are used in assessing input power transfer, specifically in finding practical geometries and/or stiffness parameters/distributions of panel members for acoustic action relying on distribution of resonant modes of bending wave action. It can be of high practical value first to investigate relative to known favourable transducer locations and to present results functionally, usefully graphically, relative to variant aspect ratios of general geometrical shape concerned in looking for minima of deviation.

In other particular inventive aspects hereof, criteria for mechanical impedance is/are used to find practical transducer locations for particular desired geometries/configurations and/or stiffness distributions of panel members for acoustic action involving bending waves, specifically and advantageously without limitation to panel members having favourable geometry/configuration such as available from said some inventive aspects. It can be of high practical value to investigate variable one relative to fixed other of co-operative areal locators such as co-ordinates of transducer location and present results functionally, usefully graphically, in looking for minimum deviation of preferably smoothed mechanical impedance. It can also be of high practical value to present results of this investigation of panel members as areal distribution of mechanical impedance or deviation thereof, conveniently in contoured manner to indicate extremes and gradations between, and for which it is a matter of choice whether to apply selected values and/or to normalise relative thereto, or to do no more than have relative step-wise gradations indicate at least best and worst locations, say within 10% or less steps.

In further aspects of invention hereof, geometries promising for acoustic action involving bending waves are investigated using a measure of mechanical impedance for promising transducer locations, and such promising geometries are further investigated in relation to use of such promising transducer locations, such investigations being capable of application cumulatively/successively/recursively for any desired degree of further refining of both of promising geometrical parameters and promising transducer location parameters.

For substantially rectangular panel members and methodology, simplification based analyses involving superposition of orthogonal beam-type functions, and with reference to 10% smoothness criteria for mechanical impedance, have confirmed and refined calculation for one known preferred aspect ratio, specifically 1:1.134 as taught in above published PCT application, to be at about 1.138:1; and refined proportionate co-ordinates for transducer location (4/9, 3/7) thereof to about (0.440,0.414). In addition, however, and starting from substantially the same transducer location co-ordinates, analyses hereof have revealed another promising aspect ratio, specifically at about 1.41 to about 1.47. In practice, particular investigation of 1.47 aspect ratio with transducer locations substantially at proportionate co-ordinate position(s) (4/9, 4/9) led by cumulative refinement to aspect ratio 1.41 and transducer co-ordinate locations 0.455, 0.452; indeed, to appreciation that there may be considerable inter-relationship between these 1.41 to 1.47 aspect ratios and variant transducer locations.

It is a particular inventive aspect hereof that a substantially rectangular panel member (as or in an acoustic device and relying on bending wave action) and substantially isotropic as to its bending stiffness in at least two directions has an aspect ratio of about 1.41:1 to about 1.47:1; and another particular aspect of invention that proportionate co-ordinate transducer location(s) involve substantially 0.453 and/or substantially 0.447.

Moreover, two other reasonably promising aspect ratios have also emerged from further development of simplified beam type analyses, namely about 1.6 and about 1.2, together with viable transducer locations at (0.41, 0.44) and (0.403, 0.406), respectively; again with expectation of useful inter-relationships between particular aspect ratios and particular transducer locations.

It has further been established for the purposes of this invention that, perhaps particularly for panel members of favourable geometries/configurations, including such variations as known to arise from anisotropy of bending stiffness (es), the above attainable high specificity as to transducer locations amounts to refined determination within more extended areas that are generally favourable in terms of transducer locations. Indeed, there is strong correlation between size of such areas, particularly medial but off-centre for panel members with isotropy of bending stiffness, and favourability of geometry/configuration, thus between what might be termed truly significant high specificity and unfavourability of geometry/configuration. At least for the latter, it can be particularly valuable to utilise accompanying analyses by scrutiny of power output with frequency and/or finite element analysis (FEA) at least to assess low frequency modality, say as indicative of start positions for analysis of transducer location as above (or below) and/or of overly intrusive resonant modes for useful correction by localised clamping/damping or for compensation by signal conditioning. Interestingly, for favourable substantially rectangular geometry/configuration viable edge adjacent transducer locations are indicated on basis of mechanical impedance characteristics/desiderata.

The above-indicated alternative techniques utilising inherently two-dimensional analysis, also in terms of mechanical impedance, generally confirm efficacy of above aspect ratios and transducer locations, including promising relatively discrete and extended areas, whether or not for hitherto favoured aspect ratios, thus efficacy of such methodology and results with manifest merit of a general nature even including converse approaches identifying particularly poor areas to be avoided for transducer location and/or aspect ratios of low prospects (albeit then capable of indicating possibly or likely viable, or best attainable singly or in combination, transducer locations in unfavourable geometries).

It is of particular practical interest that hitherto known least promising or worst cases of most symmetrical geometries, such as isotropic as to bending stiffness within square or circular boundaries, and substantially central locations of transducers, continue to be indicated as poor combinations, but that much more or most promising transducer locations can now be identified even to the point of viability at least for perhaps relatively limited frequency ranges and output responses.

Inventive methodology hereof and results obtainable can take account of boundary conditions ranging from free or only lightly damped to more strongly damped and constrained including clamped for which promise is, if anything, now highest (and practically highly beneficially so in relation to actual physical implementation and presentation of acoustic devices hereof, particularly in or as panel-form loudspeakers).

BRIEF DESCRIPTION OF THE DRAWINGS

Exemplary specific implementation of methodology embodying this invention, including results thereof, is now described and detailed with reference to the accompanying diagrammatic drawings, in which.

PARTICULAR EMBODIMENT(S) OF THE INVENTION

Figure 1:
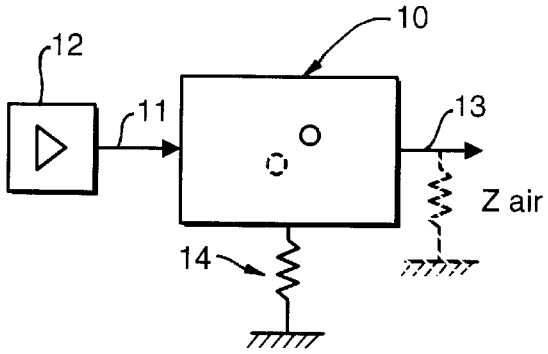
FIGS. 1 is an outline diagram indicating basis of specific implementation hereof.

In FIG. 1, an active acoustic device, specifically a distributed mode acoustic panel member complete with exciting transducer(s) is represented by block 10, basically as a "black box" with electrical input 11 shown from such an audio amplifier, acoustic output 13 shown in phantom for in-principle completeness in equivalent electrical terms as driving resistive impedance Zair, and indication of intrinsic losses also in electrical terms as resistive leakage path 14 to ground.

By its nature as a structure sufficiently stiff to support bending wave action and afford useful acoustic coupling to air, a resonant mode acoustic panel component of "black box" 10 will have low loss. Also, bending wave transducers along with usual couplings to such panel generally have low losses; and overall loss represented by path 14 tends to be low, at least compared with input and output power at 11, 13—which would be good for proposed analysis whether or not smooth, but does also tend to be reasonably smooth thus further beneficial.

Figure 2:
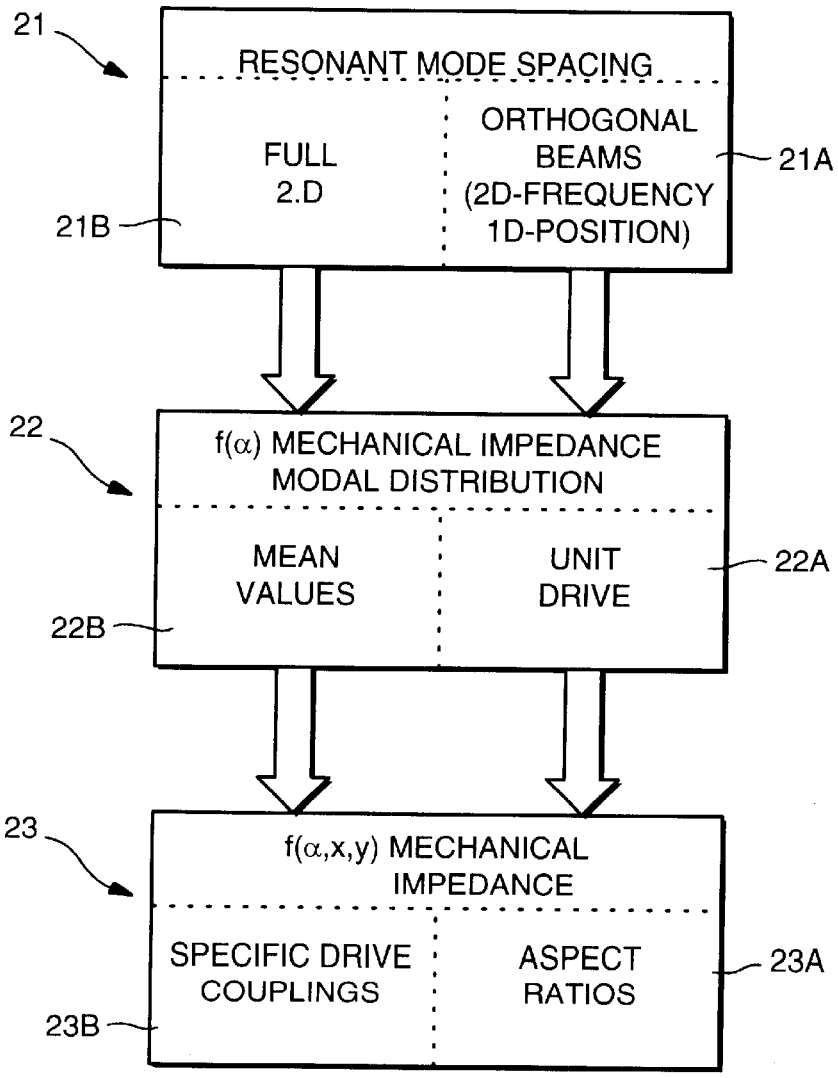
FIG. 2 indicates rationale(s) of analytical processing hereof.

FIG. 2 is believed to be helpful for understanding basis of analytical assessment for which worked examples will be given relative to later Figures. Block 21 indicates a first useful exercise to some extent common to the above-mentioned published PCT application, specifically looking at spacings of resonant mode frequencies. Indeed, such inspection based on angled single dimensions relevant to fundamental frequencies, specifically as for notional orthogonal beams parallel to sides of a rectangular panel member, is indicated at 21A; and is, of course, inherently of a nature that is positionally one-dimensional though capable of limited two-dimensional application as to frequency. More complete two-dimensional treatment is indicated at 21B, essentially using inherently two-dimensional equations of vibration in plates.

The next indicated stage 22 represents investigation of modal distribution and mechanical impedance, on the one hand relative to assumed equal or unit excitement of each mode (22A), i.e. without application of any differential weighting; and on the other hand taking account of mean values (22B), preferably with further selective adjustment for end-most modal frequencies involved. A further stage of inter-active assessment of estimated mechanical impedance is indicated at 23, specifically as to aspect ratios relative to specific drive-coupling transducer positions (23A) and as to specific transducer positions relative to aspect ratios (23B).

Figure 3A:
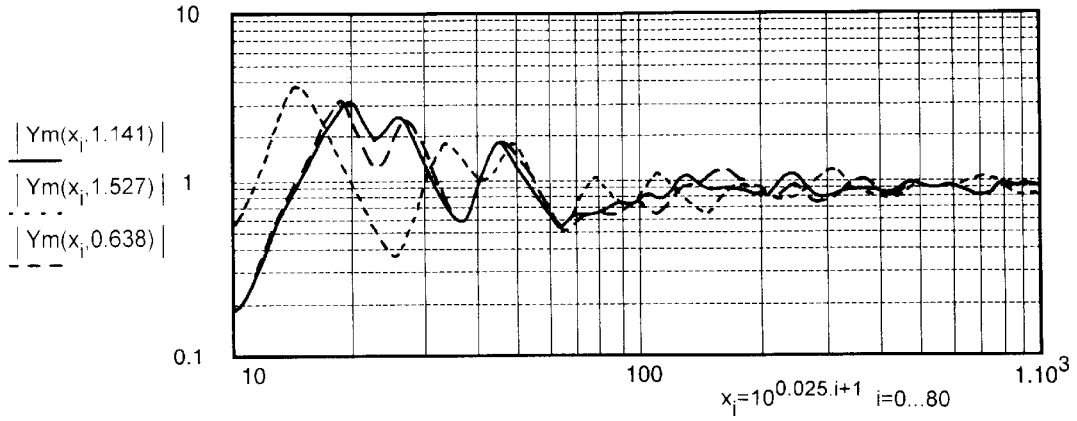
FIGS. 3A and 3B are graphical representations of mechanical impedance with frequency in substantially rectangular isotropic panels starting with selected aspect ratios.
Figure 3B:
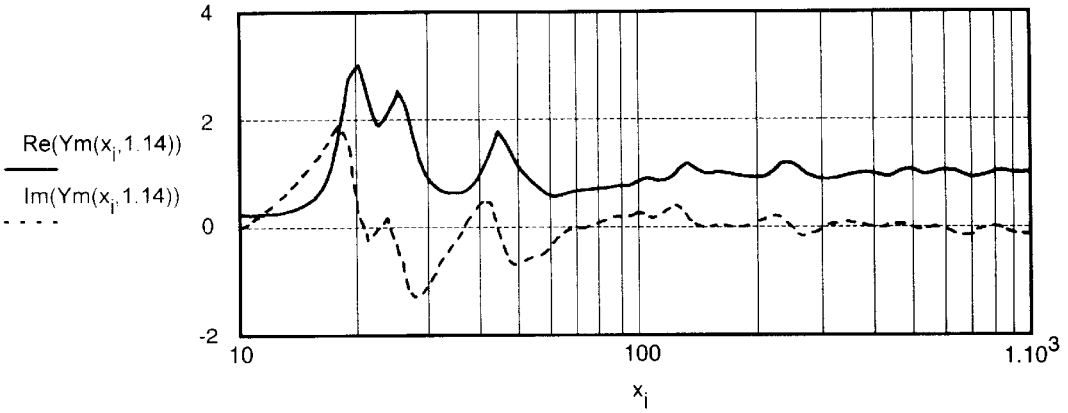

More specifically, FIG. 3A shows variation of mechanical impedance with frequency choosing rectangular panel aspect ratios expected to be above (1.527), below (0.838) and between (1.141) optimum for useful acoustic action substantially isometric panels. FIG. 3B shows real and imaginary components of the mechanical impedance for the intermediate aspect ratio (1.141). Generally smooth nature at higher frequencies is apparent, and importance of resonance modes at lower frequencies is implicit, as already well established from the above published PCT application, particularly distribution as evenly as practical.

Figure 4A:
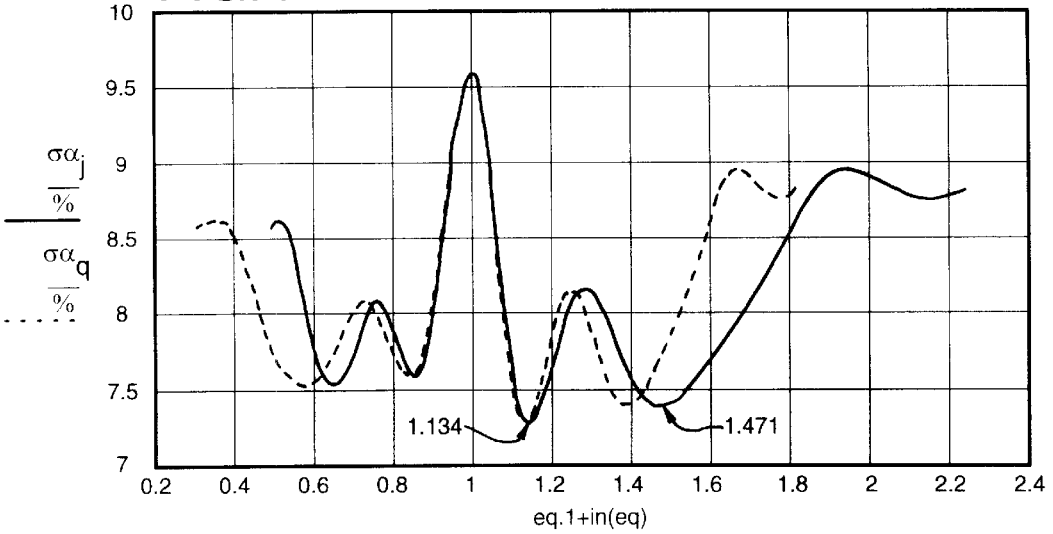
FIGS. 4A, B and C are graphical illustrations of a measure of smoothed mechanical impedance (deviation/variation) for particular transducer locations to indicate useful aspect ratios of rectangular panels.

FIG. 4A plots a measure (SD) of standard deviation of mechanical impedance against aspect ratio for a substantially isotropic rectangular panel member with a preferred transducer location from the above published PCT application, specifically at proportionate length and width co-ordinates (0.444, 0.429), and subject to a smoothing factor of 10%. Expected optimum aspect ratio of 1.134:1 is substantially confirmed by one minimum of the plot. However, other minima appear, particularly one of promising depth and greater width, i.e. less sharply defined, specifically bottoming at about 1.47:1.

Further investigations of these aspect ratios for standard deviation of mechanical impedance against proportionate co-ordinate values for transducer locations have led to useful refinement of the latter. Thus, for the aspect ratio of 1.134:1 of the above published PCT application, plots of FIGS. 5A–D in turn set each of length and width proportionate transducer location co-ordinates to the established values of 3/7 and 4/9 and show 10% smoothed standard deviation of mechanical impedance for the other proportionate co-ordinate, i.e. of width and length, respectively. These investigations result in refinement of the 0.444 value to 0.441 and of the 0.429 value to 0.414; and results of listening tests have shown noticeably improved performance; both subjectively and objectively within constraints and limitations of such measurement exercises.

The plots of FIGS. 6A–D likewise investigate the unexpected aspect ratio possibility at its minimum value of about 1.47:1. The resulting values for length and width proportionate co-ordinates of transducer location are 0.453 and 0.447. Further listening tests have shown excellent promise for acoustic performance, and the lesser curvature of the minimum concerned in FIG. 4A is believed to be particularly advantageous by reason including actual practical transducers inevitably having extent beyond their centring at particular prescribed positions.

Figure 4B:
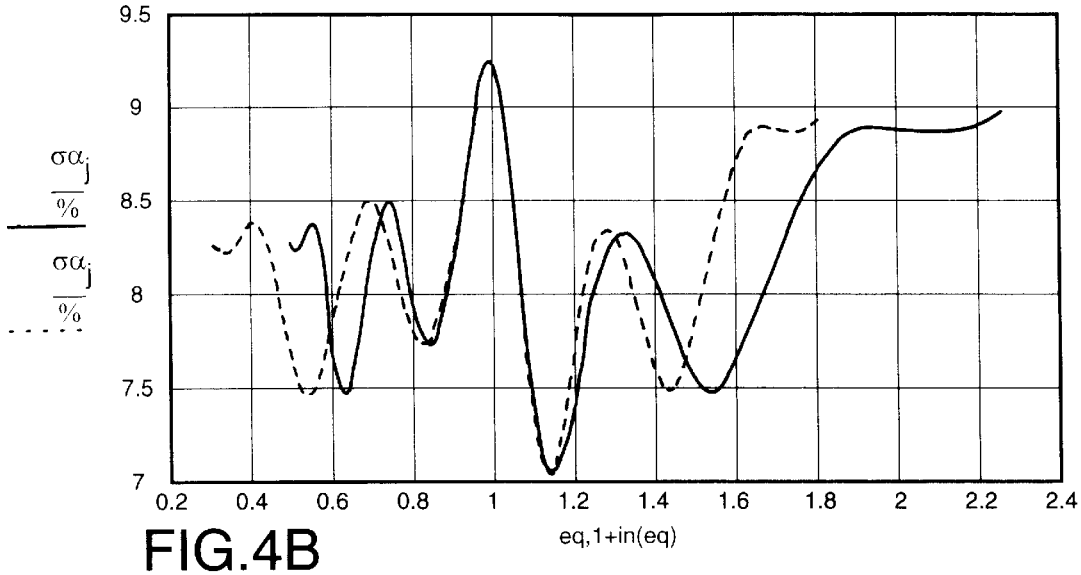
Figure 4C:
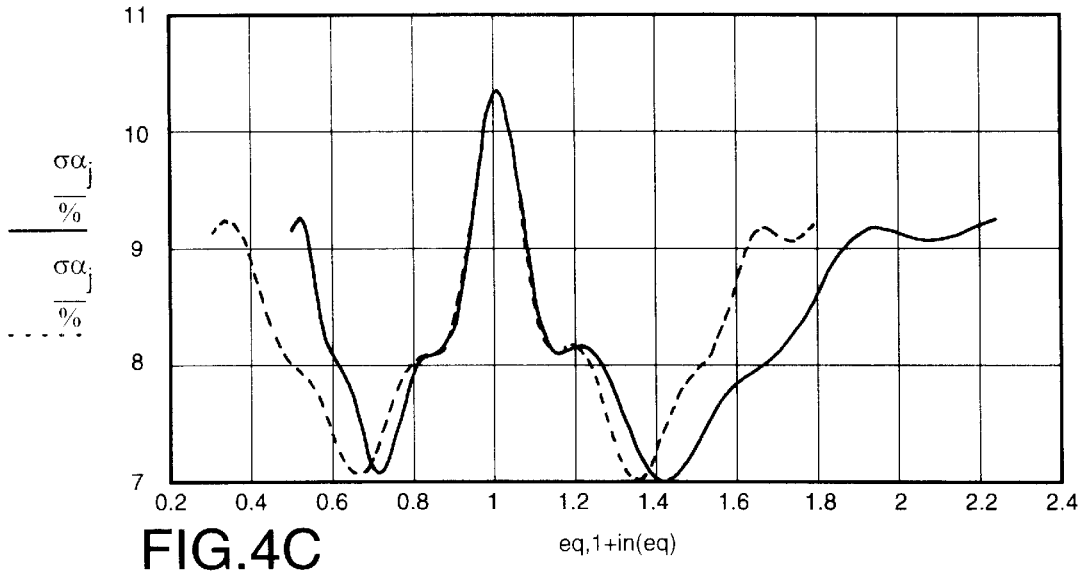
Figure 5A:
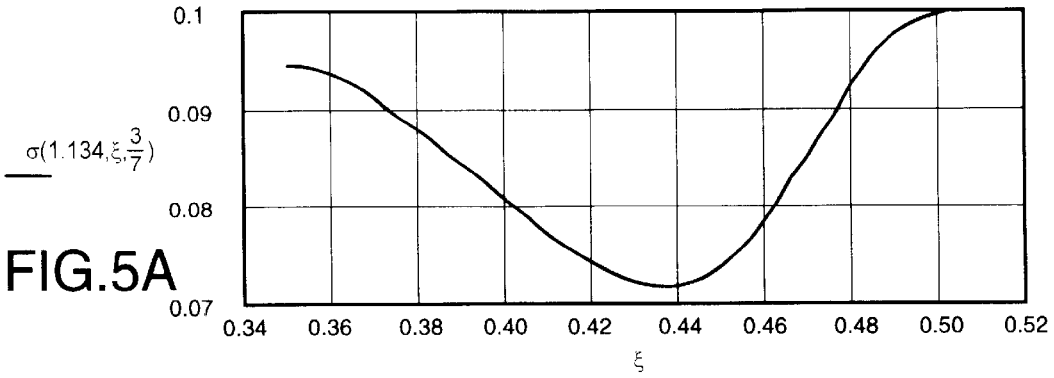
FIGS. 5A–D are graphical illustrations for one previously known particular panel aspect ratio and known values of one transducer location co-ordinate to investigate value of the other co-ordinate.
Figure 5B:
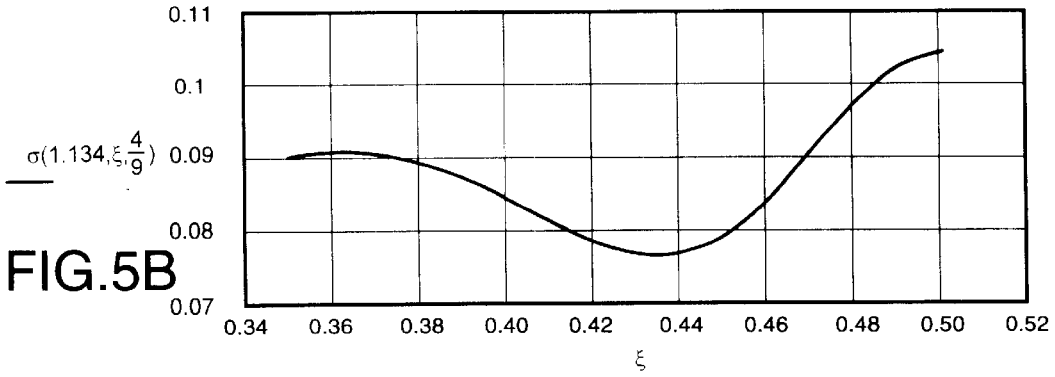
Figure 5C:
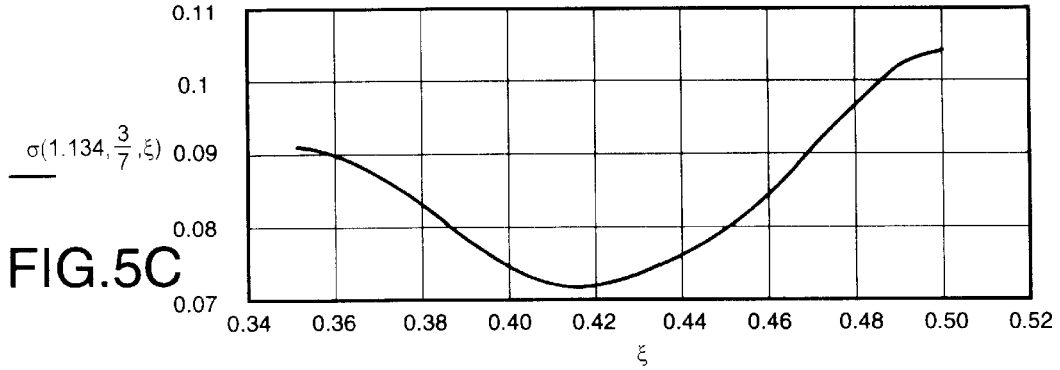
Figure 5D:
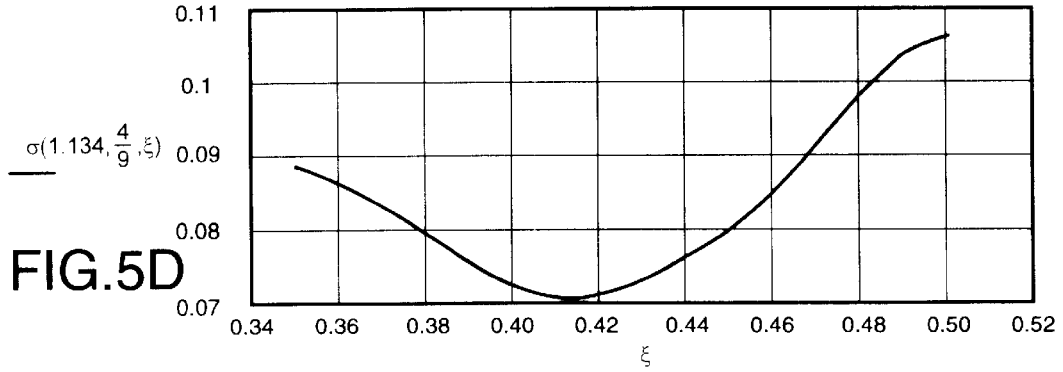
Figure 6A:
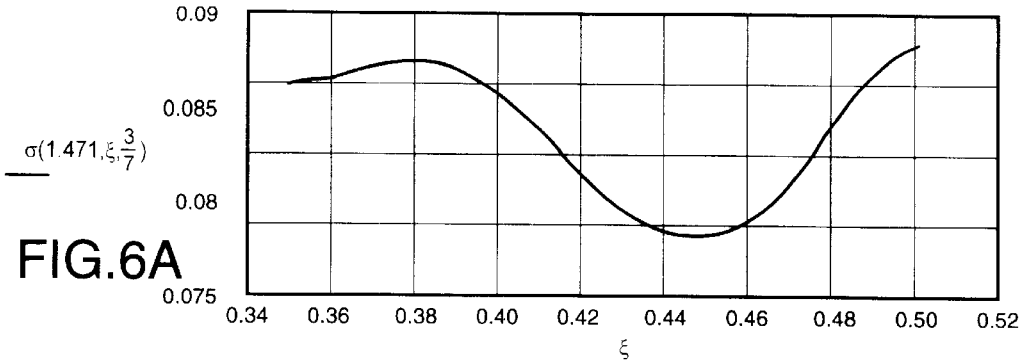
FIGS. 6A–D are graphical illustrations for another previously unknown particular panel aspect ratio and known values of one transducer location co-ordinate to investigate values of the other co-ordinates.
Figure 6B:
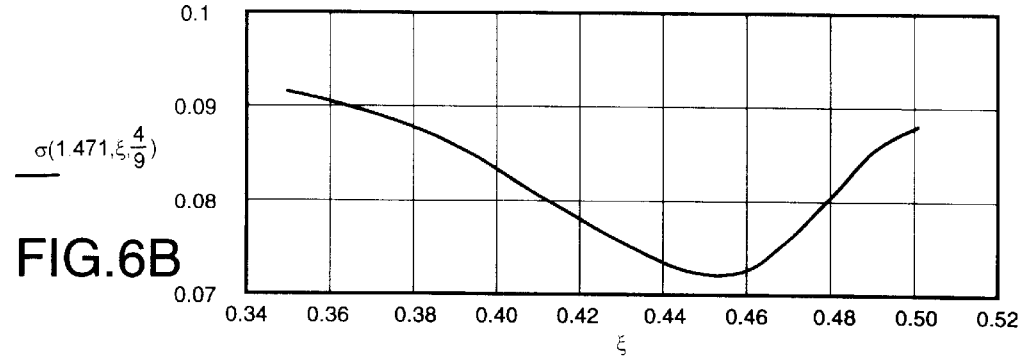
Figure 6C:
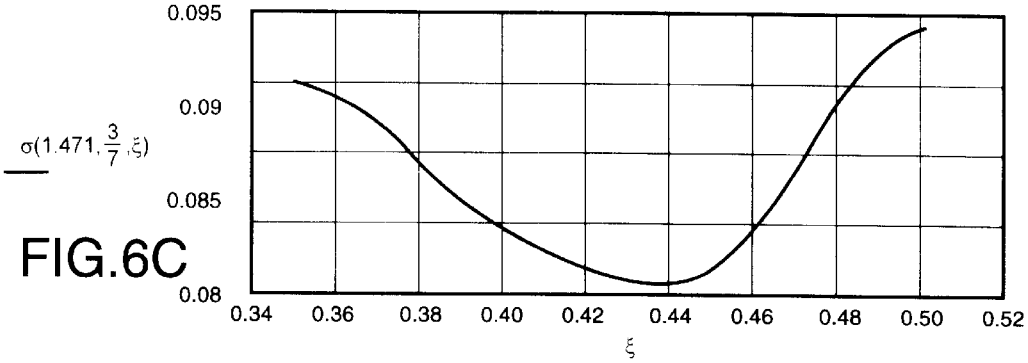
Figure 6D:
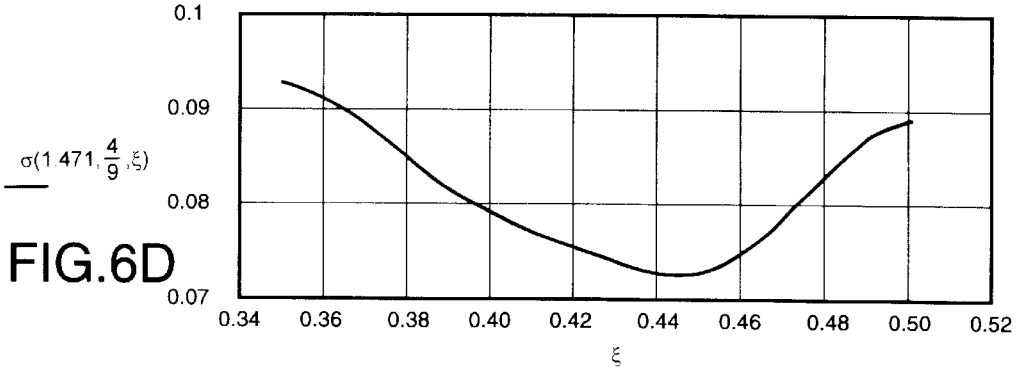

The investigation represented by FIG. 4A was then repeated for the transducer location co-ordinate values arising from FIGS. 5A–D and FIGS. 6A–D, and results shown in FIGS. 4B and 4C, respectively. FIG. 4B shows that the minimum for the standard deviation of mechanical impedances bottoming at the aspect ratio 1.134:1 is deepened and sharpened, whereas that at 1.47:1 is less deep and sharper. This, of course, correlates well with the greater changes of co-ordinate values arising from FIGS. 6A–D compared with FIGS. 5A–D. FIG. 4C produces a refinement of the aspect ratio 1.47:1 to 1.41:1, including to a deeper minimum of standard deviation of mechanical impedance. The interestingly deep minimum at an aspect ratio of about 0.72:1 is, of course, close to reciprocal for 1.41:1, thus to be expected; and, for the indicated lesser minima at about 0.66:1 and 0.85:1 in FIG. 4A, perhaps particularly in view of refining a little downwards in FIG. 4B, there is closeness to the reciprocals for upper of the range 1.141/1.47:1 and lower of 1.134/1.138:1, respectively.

Indeed, much as these processes of refinement, including mutual refinement, can be of value in optimising for best available acoustic performance, they appear to be as valuably viewed in terms of indicating ranges of variation for viable acoustic operation. Particular merit arises in identifying areas of viable location for transducer means, perhaps especially for panel members with favourable geometry/bending resistances, and further for optimisation of locations for two or more transducer means on the same panel member. However, at least equal merit arises in identifying best available locations for transducer means on panel members of unfavourable geometry/bending stiffnesses. Much the same applies to identifying worst locations for transducer means, i.e. as to be avoided even where high acoustic performance is not deemed to be necessary. Accordingly it is found to be useful to present analytical results on a relative basis, effectively in percentage terms, though any particular values could be applied, and normalisation may be seen as useful. It is the case that favourable geometry panel members show larger areas for likely viable-to-good/best locations for transducer means, and unfavourable geometry panel members show smaller such areas; and that edge locations are confirmed as viable, though perhaps normally best used in pairs to ensure similar excitation of resonant modes that useful beam-based simplifications indicate as related to different geometrical axes.

Moreover, due account should be taken of available power output, whether as to low being acceptable for evenness of excitation of more resonant modes, or high being preferred even at cost of fewer modes excited and/or less evenly excited. However, higher numbers and more evenness are usually associated with smoothness of power, and are most readily compensated towards flatness by suitable electronic input signal conditioning, at least where power efficiency is not necessarily of paramount importance.

Figure 7A:
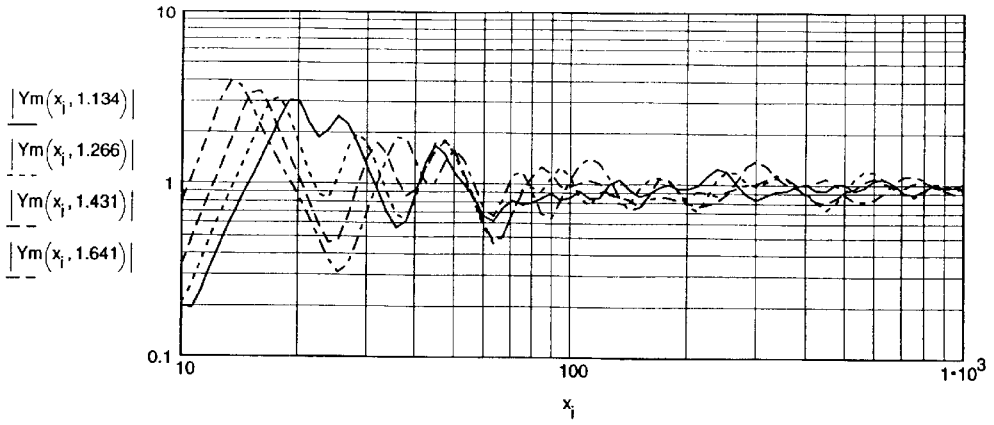
FIGS. 7A and 7B are generally similar to FIG. 3 but starting with other selected aspect ratios.
Figure 7B:
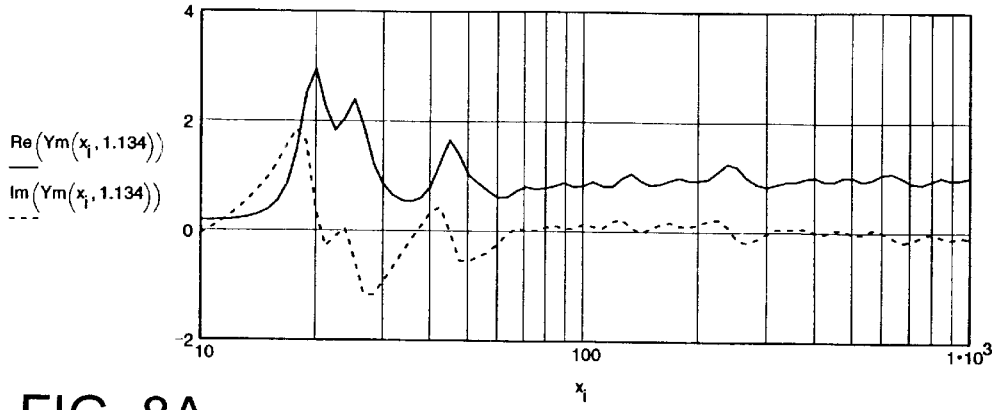
Figure 8A:
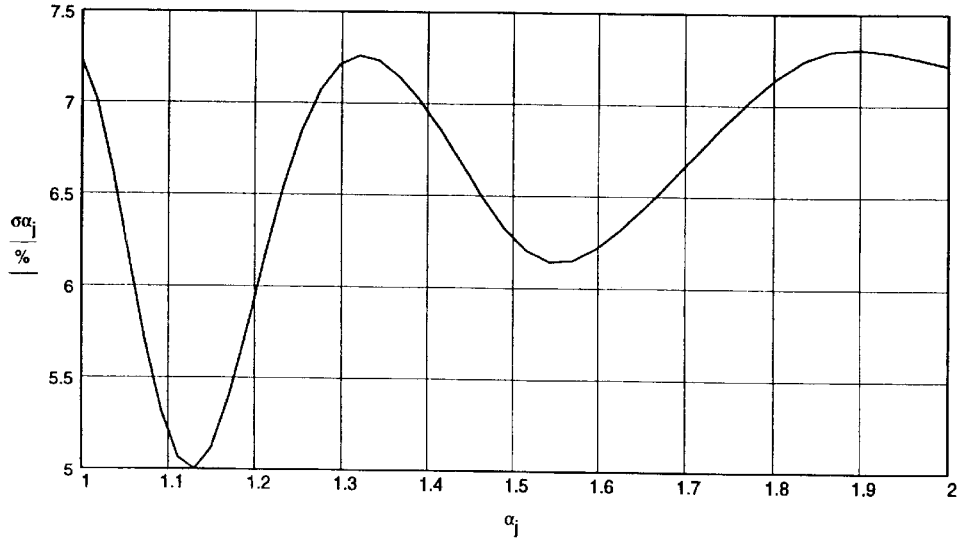
FIGS. 8A–D are generally similar r to FIG. 4 showing confirmation of aspect ratios previously indicated as useful (FIGS. 8A, B) and also indicating further promising aspect ratios.
Figure 8B:
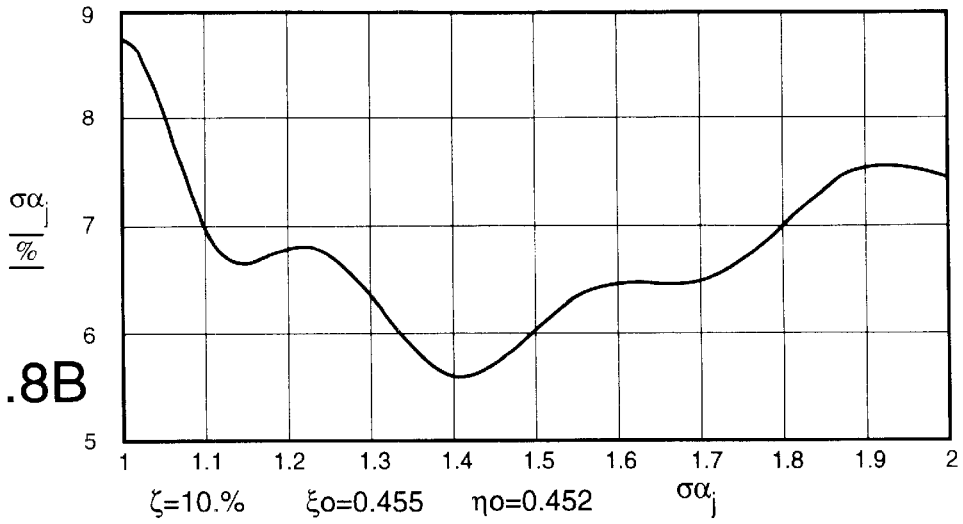
Figure 8C:
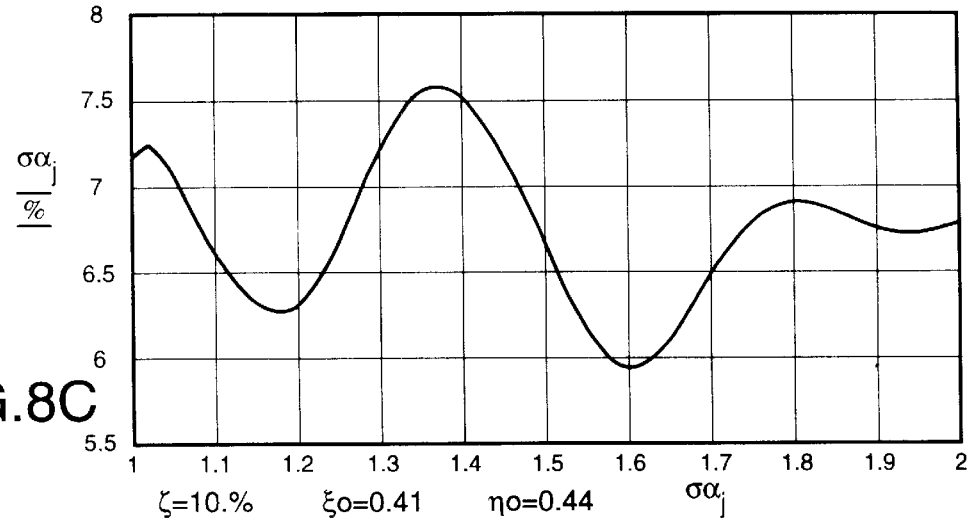
Figure 8D:
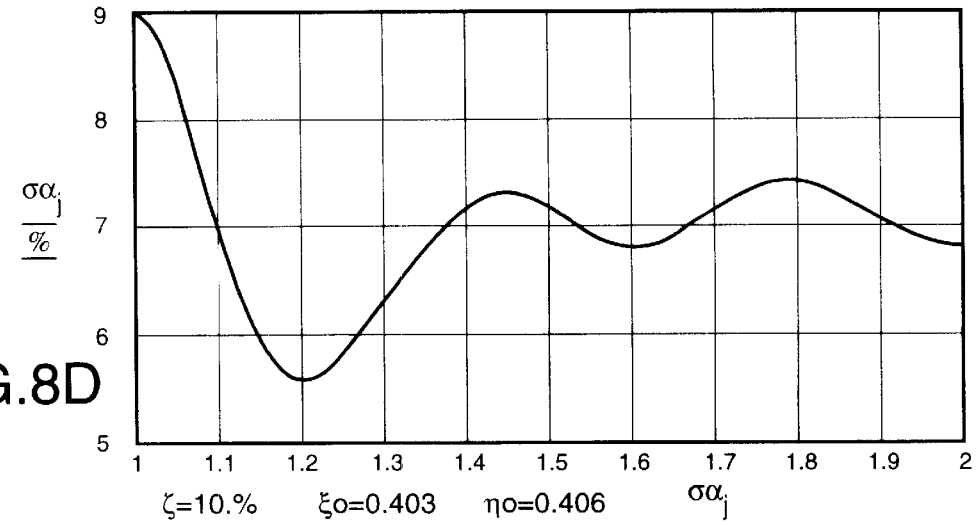
Figure 9A:
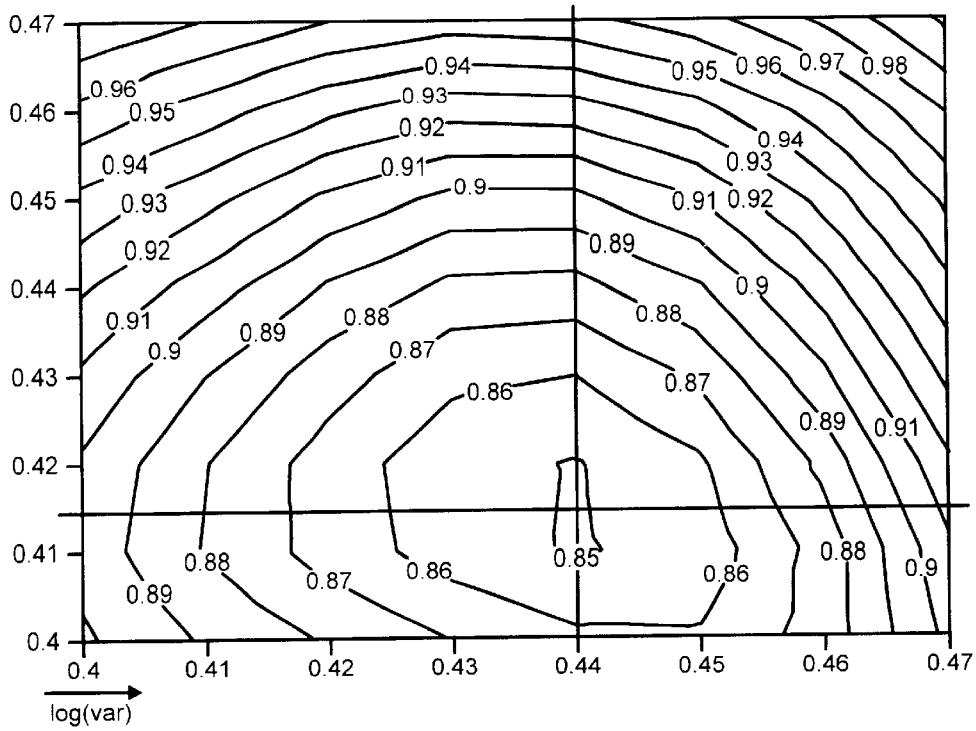
FIGS. 9A–D are areal contour plots of mechanical impedance demonstrating transducer location co-ordinate determination for panels with aspect ratios indicated in previous Figures.
Figure 9B:
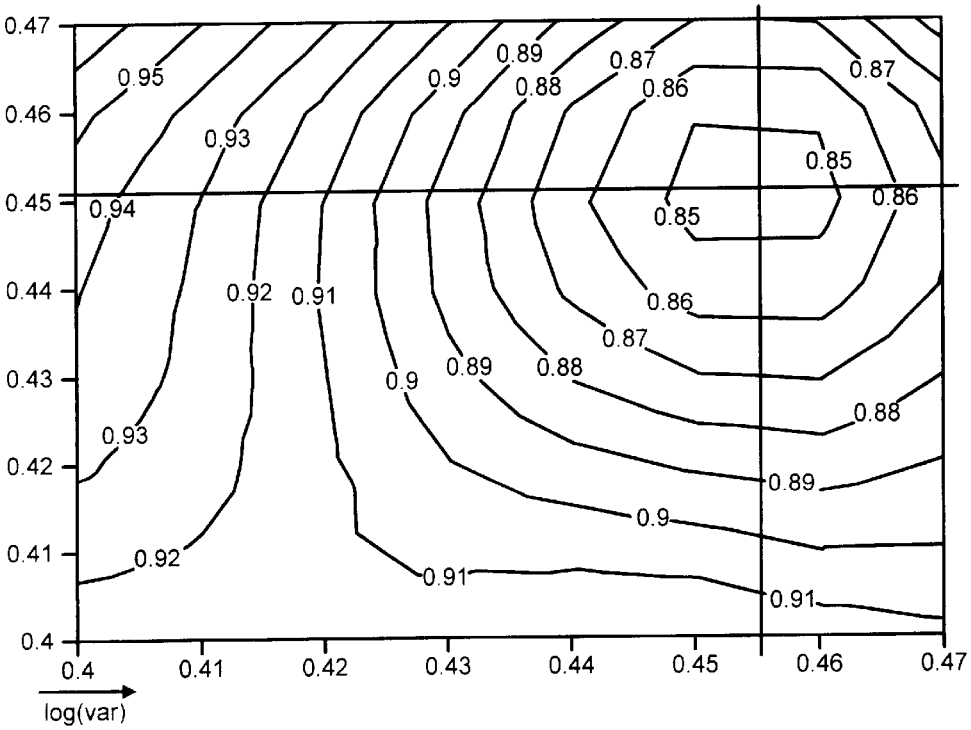
Figure 9C:
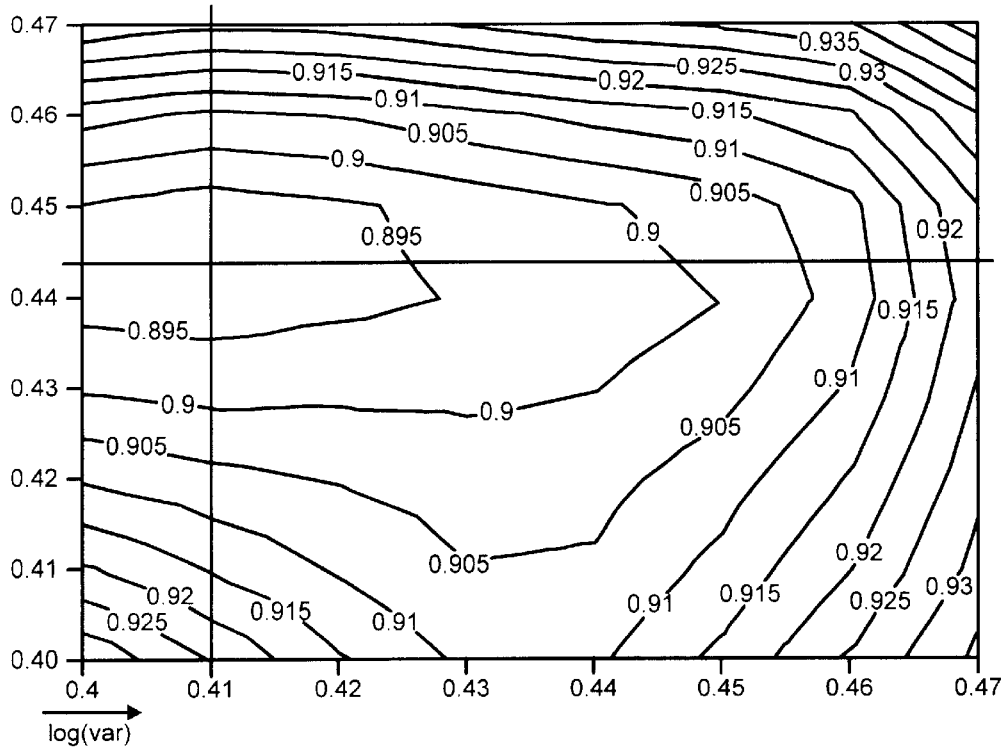
Figure 9D:
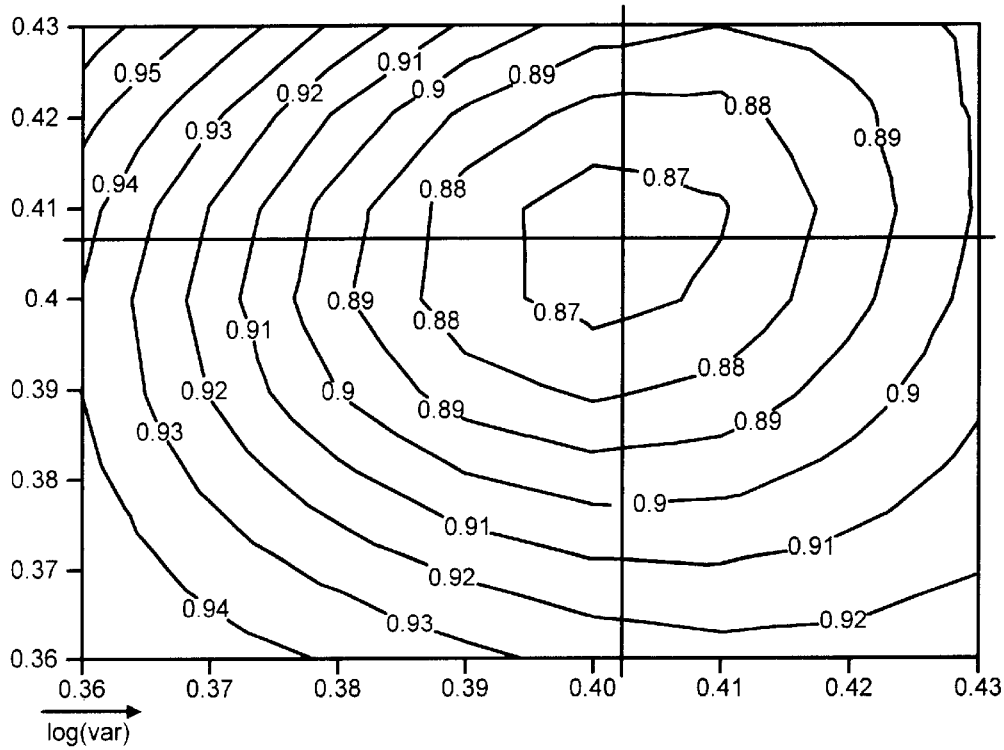

FIGS. 7A, B indicate arriving at the aspect ratios 1.38 and 1.41, together with transducer location co-ordinates (0.44, 0.414) and (0.455, 0.452), respectively, see FIGS. 8A, B, by a route as above for FIGS. 3A, B etc, but starting from aspect ratios 1.149, 1.134 and 1.762. Interestingly, however, further indication arises other favourable aspect ratios at about 1.6 and 1.2, with transducer location co-ordinates (0.41, 0.44) and (0.403, 0.406), respectively, see FIGS. 8C, D. The mechanical impedance plots of FIGS. 9A–D are generally useful regarding the transducer location co-ordinates, as is evident by inspection for all of above aspect ratios, i.e. 1.138, 1.41, 1.6 (taken as refined to 1.62 or during refinement to 1.6) and 1.2 (taken as refined to 1.266 or during refinement).

Figure 10A:
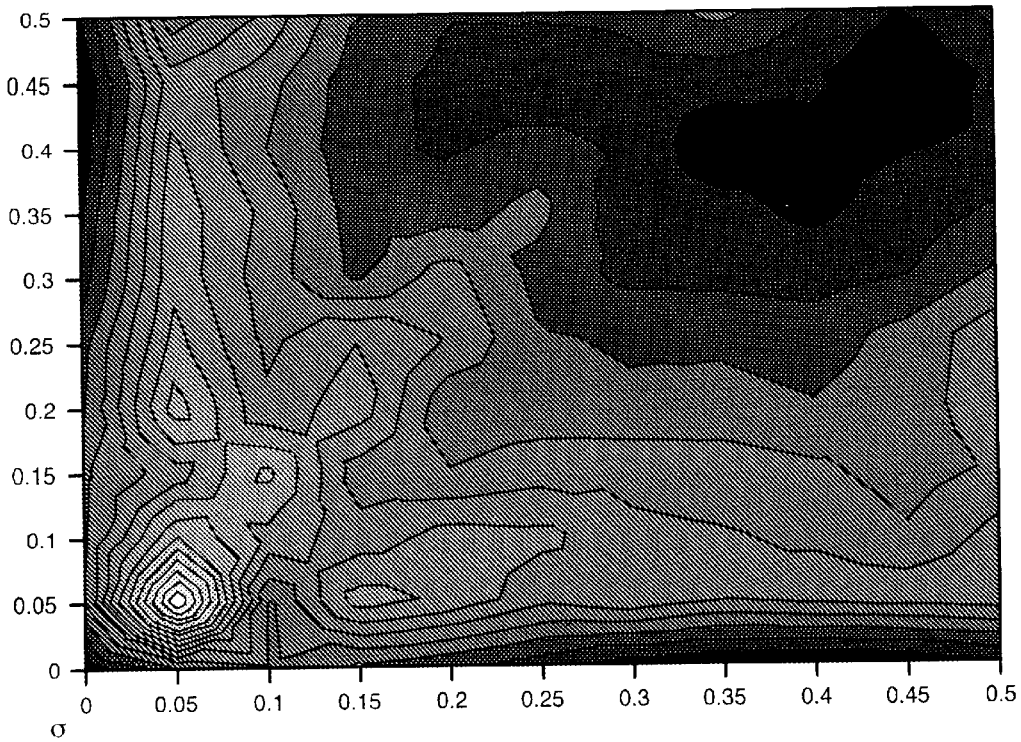
FIGS. 10A, B are quarter-panel areal contour plots for smoothness of mechanical impedance for the aspect ratios of FIGS. 6A–D.
Figure 10B:
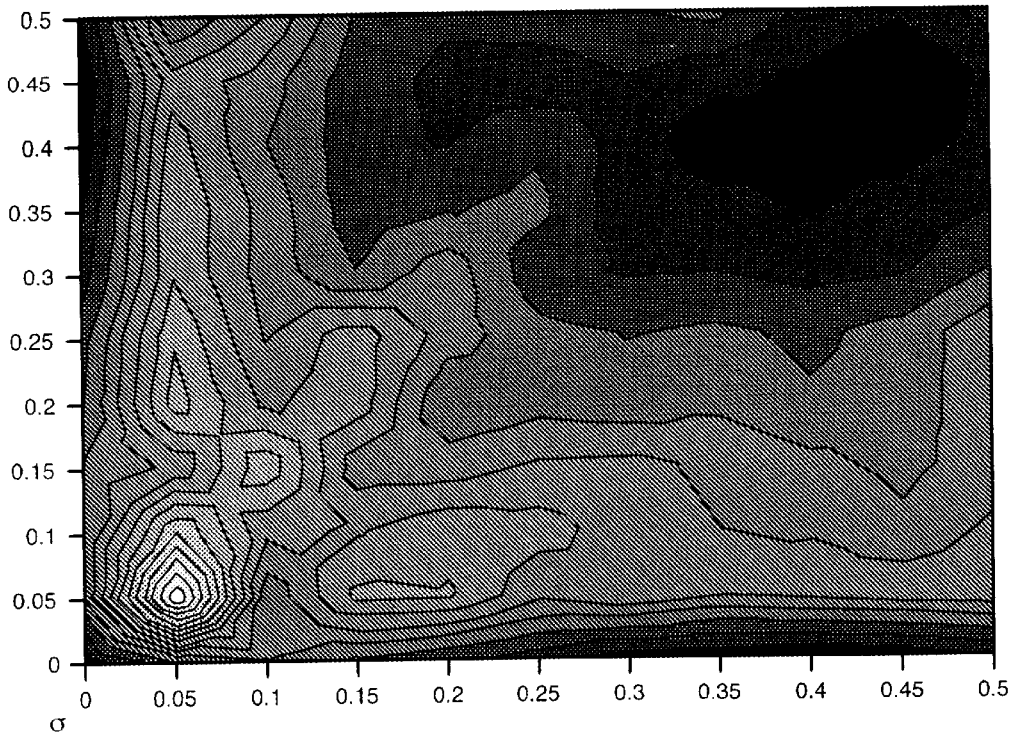

Generality of such usefulness is manifest in self-evident identification of areas including precisely calculated locations. At least where such areas are larger than transducer dimensions, good excitation coupling is to be expected along with tolerance of actual location without losing viability. FIGS. 10A, B are quarter panel contour plots of mechanical impedance deviation for the aspect ratios 1.41 and 1.47, respectively, and establish credence for such range affording good transducer locations, see substantial extents of areas of least/smoothest mechanical impedance location (cross hatched), albeit within which further precise calculation is available as desired/useful.

Indeed, this technique lends itself readily to extension for investigation of best available transducer locations even for panels other than identified as favourable. Identified such locations may well have more viable mechanical impedance than for better aspect ratio panels, but can be viable at least for somewhat lesser frequency ranges of operation.

It is also feasible to investigate virtually any boundary conditions for acoustic panels, ranging from substantially free or only lightly damped as specifically described in the above published PCT application to much more constrained, even clamped. Indeed, preferential co-ordinate positions have even been identified for a circular panel at (0.8, 0.6).

Figure 11A:
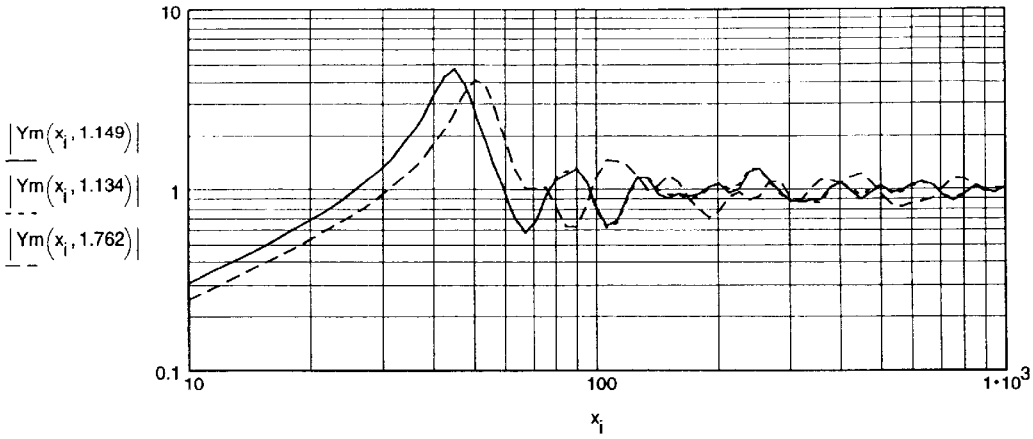
FIGS. 11A, B and 12A, B and 13A, B are also generally similar to FIGS. 3A, B but for boundary conditions in which all panel edges are clamped.
Figure 11B:
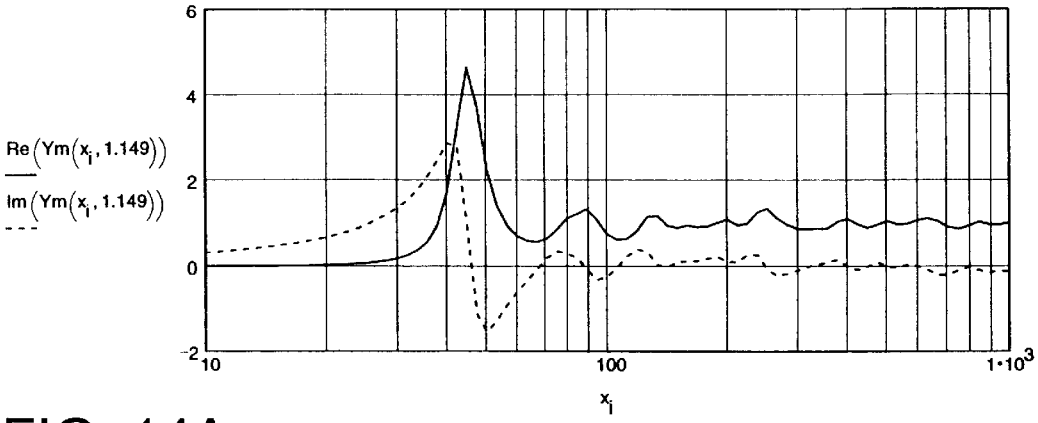
Figure 14A:
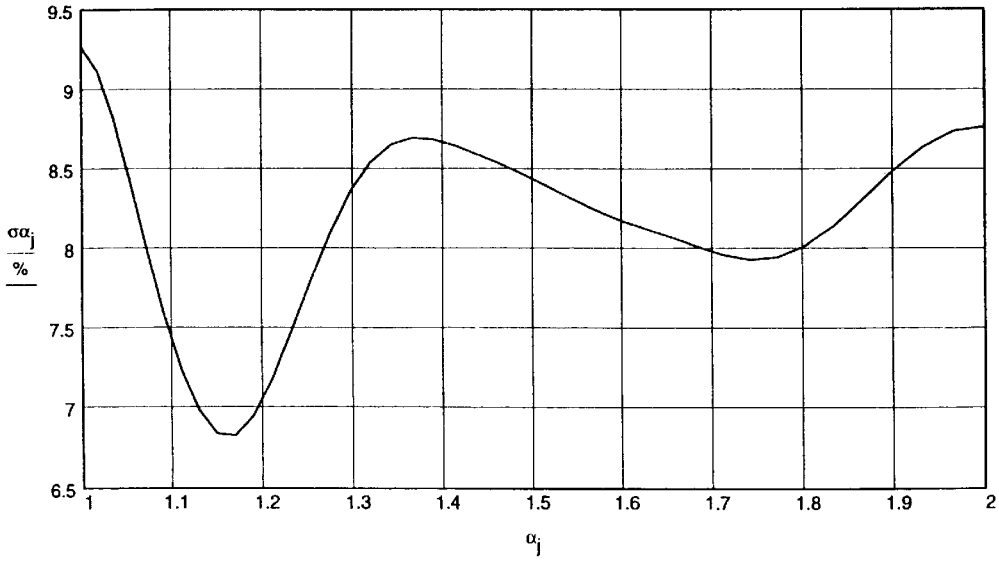
FIGS. 14A–C are generally similar to FIG. 4 but related to FIGS. 11, 12, 13 and location of promising aspect ratios.
Figure 12A:
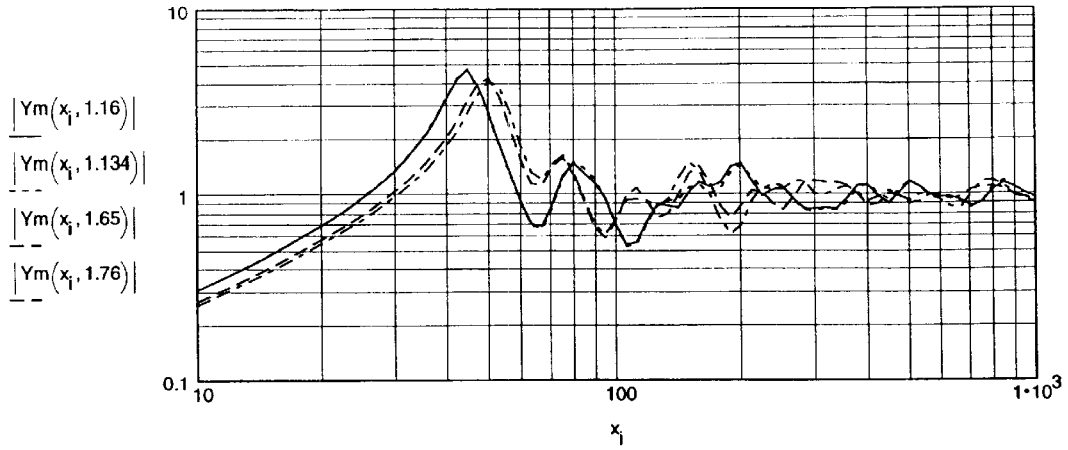
Figure 12B:
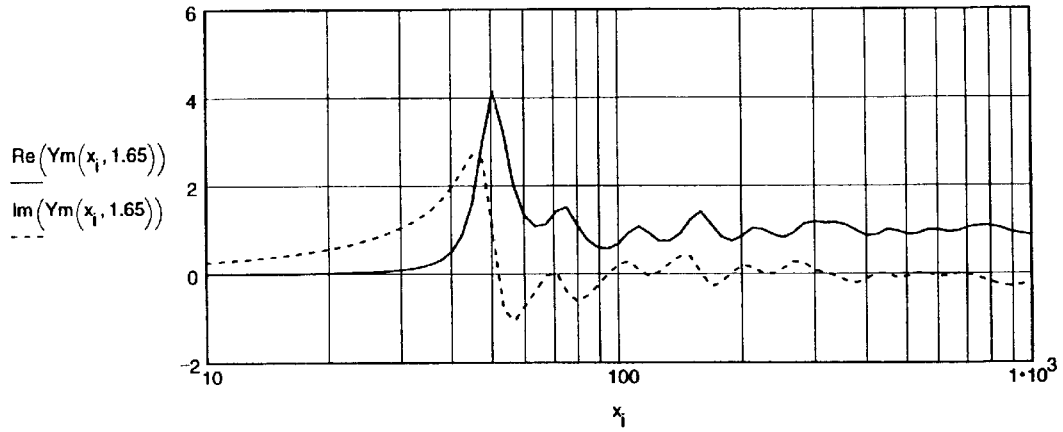
Figure 14B:
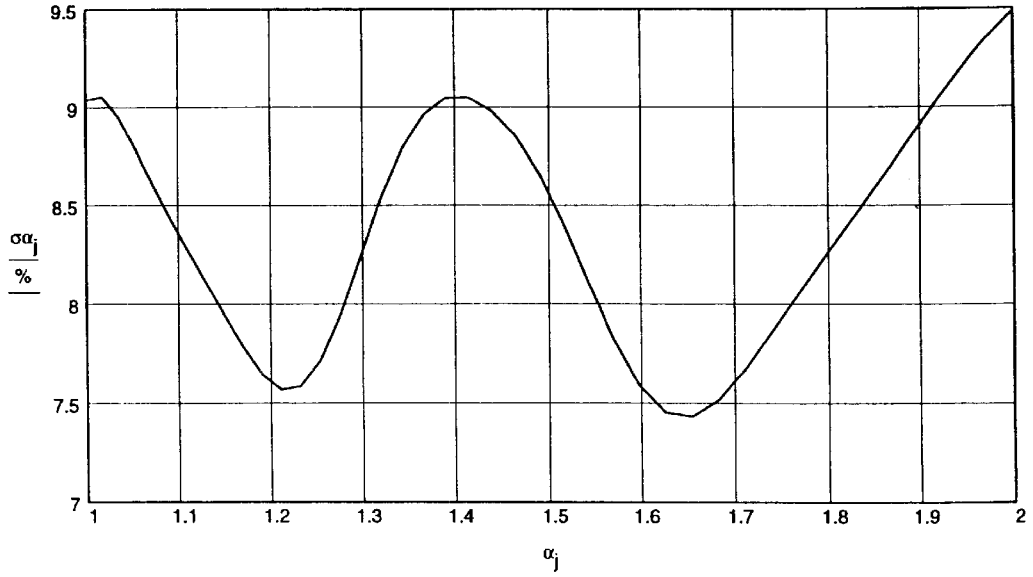
Figure 13A:
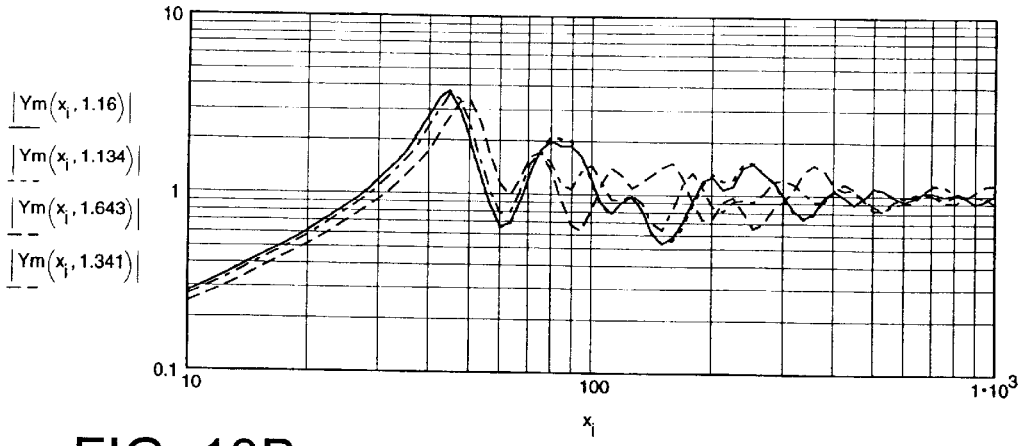
Figure 13B:
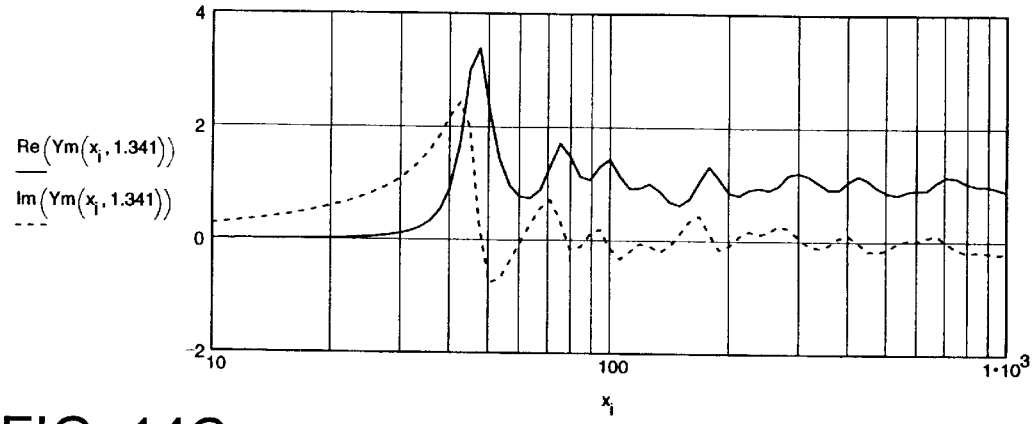
Figure 14C:
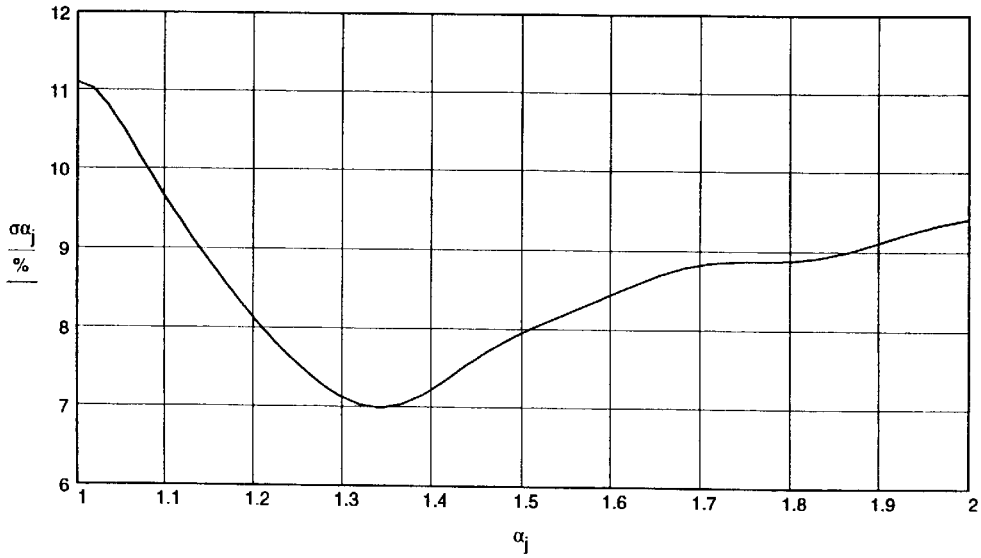
Figure 15:
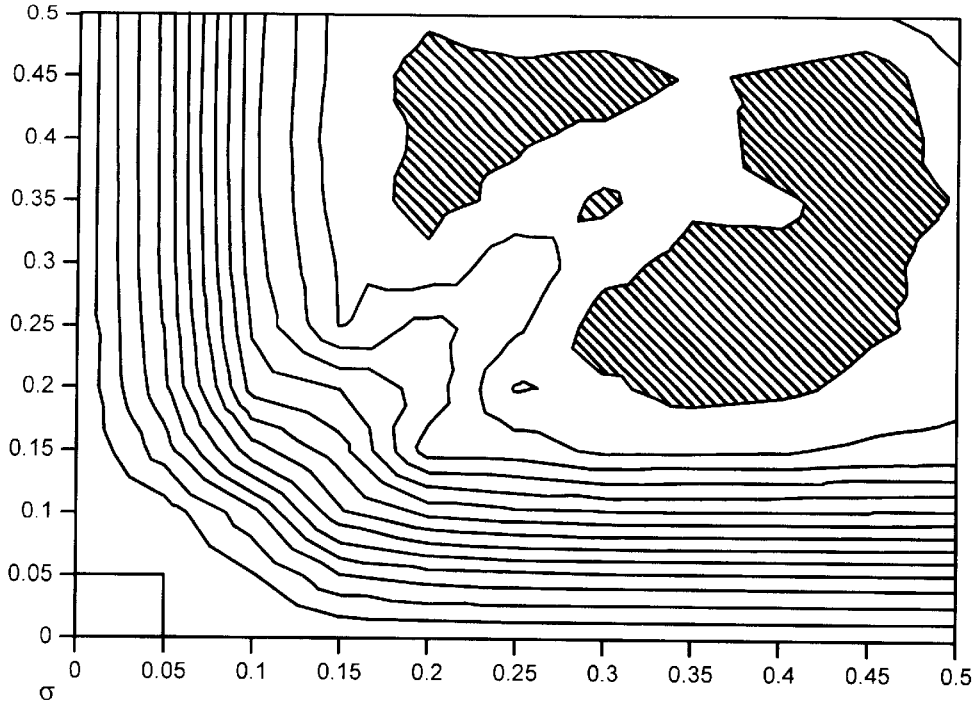
FIG. 15 is similar to FIGS. 10A–D relative to the aspect ratio of FIG. 13A.

Investigation of aspect ratios for fully clamped panels, as highly suitable for practical loudspeaker equipment with preference for rigid or semi-rigid edge-mounting, has revealed precisely calculated favourable aspect ratios 1.160, 1.341 and 1.643 together with likewise precisely calculated preferential transducer location co-ordinates (0.437, 0.414), (0.385, 0.387) and (0.409, 0.439), respectively. FIGS. 11A, B with FIG. 14A, FIGS. 12A, B with FIG. 14B and FIGS. 13A, B with FIG. 14C demonstrate application of analytical methodology as above for FIGS. 3A, B etc in confirmation of values just listed—see also the quarter-panel mechanical impedance plot for the aspect ratio 1.16 and substantial extent of areas promising for transducer location, even two such separate areas, (cross hatched).

Figure 16:
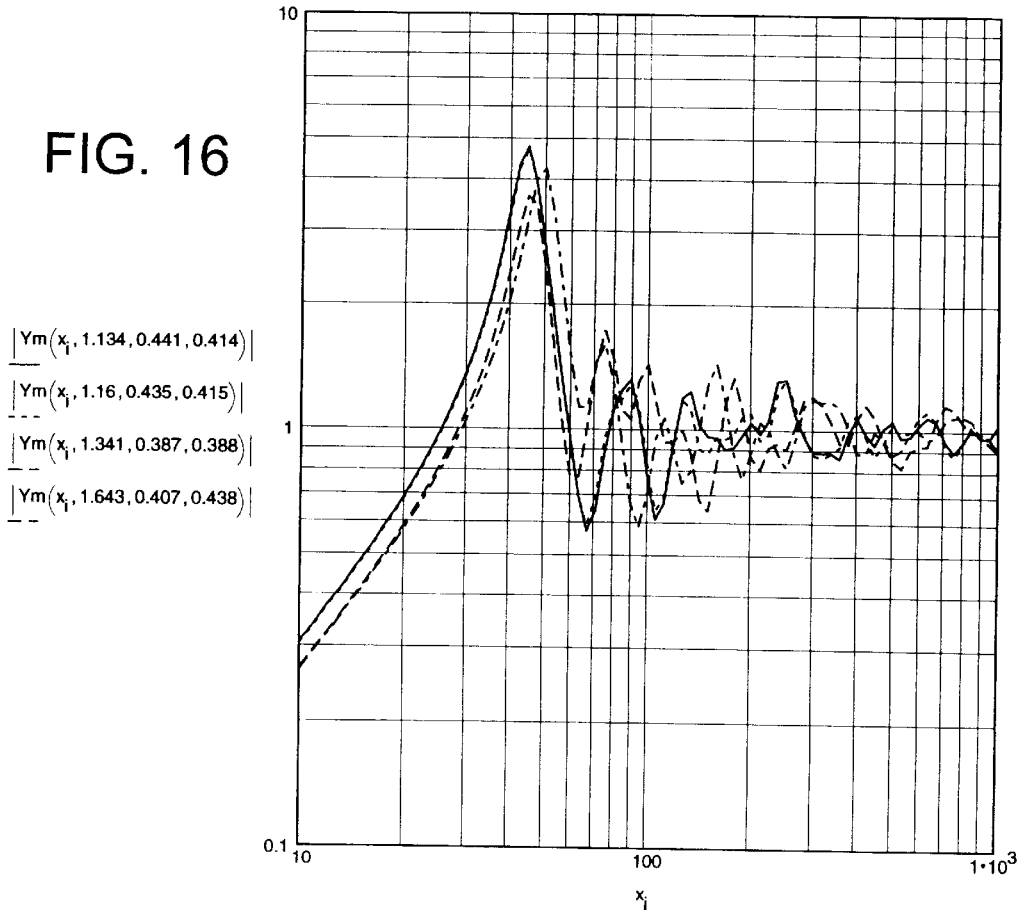
FIG. 16 shows graphical comparison of the frequency responses of various aspect ratio panels, including those of FIGS. 11, 12 and 13.

Indeed, much as for the aspect ratio 1.138 for free or near-free panel edge conditions, the actually quite close aspect ratio 1.160 for clamped edge panels appears to have significant extent(s) of at least viable transducer locations—and is itself postulated as having substantial tolerance, at least with likely increasing particularity of transducer locations. FIG. 16 gives revealing comparison of above preferential clamped edge aspect ratios and transducer locations, including further for above aspect ratio 1.138.

Particular exemplification is now given of specific mathematics and calculation/computation supporting above given results in terms row by row of

- eigenvalues corresponding to investigated resonant modes, and smoothing factor
- useful angle definitions
- specific panel parameters and related expressions displacement functions for different (free/clamped) boundary conditions length/width fractions for proportionate transducer location co-ordinates along with formula involving mechanical impedance three mechanical impedance formulae two ratios of infinite and finite panel impedances involving aspect ratios and transducer locations all intendedly without prejudice to generality implicit in approach hereof.

EXAMPLE I calculate eigenvalues $p := 0 \ldots 14 \quad q := 0 \ldots 14 \quad \zeta := 10 \cdot \%$ $$\lambda_p := (2 \cdot p + 1) \cdot \frac{\pi}{2} \qquad \lambda_0 := 0 \qquad g := 0$$

$$\lambda_p := \mathrm{root}\left(\tan\left(\frac{\lambda_p + g}{2}\right)^2 - \tanh\left(\frac{\lambda_p + g}{2}\right)^2, g\right) + \lambda_p$$

$$\mathrm{Area} := 0.141093 \cdot m^3 \quad B := 8.82\ N \cdot m \quad \mu := 0.694 \quad \omega c = \frac{1}{\mathrm{Area}} \cdot \sqrt{\frac{B}{\mu}}$$

$$\omega m_{p,q} = \sqrt{\frac{B}{\mu}} \cdot \left[\left(\frac{\lambda_p}{Lx}\right)^2 + \left(\frac{\lambda_q}{Ly}\right)^2\right] \qquad C_p := \frac{\cos(\lambda_p) - \cosh(\lambda_p)}{\sin(\lambda_p) + \sinh(\lambda_p)} \qquad C_o = 1$$

$$Zfree(p, \zeta) := \mathrm{if}\ [p > 0, (\cos(\lambda_p \cdot \zeta) + \cosh(\lambda_p \cdot \zeta)) \cdot C_p + (\sin(\lambda_p \cdot \zeta) + \sinh(\lambda_p \cdot \zeta)), 1]$$

$$Zfor(p, \zeta) := \mathrm{if}\ [p > 0, (\cos(\lambda_p \cdot \zeta) - \cosh(\lambda_p \cdot \zeta)) \cdot C_p + (\sin(\lambda_p \cdot \zeta) - \sinh(\lambda_p \cdot \zeta)), 0]$$

$$\xi 0 := 0.441 \quad \eta 0 := 0.414 \quad Y_{p,q} := \left(\frac{Zfree(p, \xi 0)}{C_p}\right)^2 \cdot \left(\frac{Z_{free}(q, \eta 0)}{C_q}\right)^2$$

$$Zm(\omega) = \frac{\mu Lx \cdot Ly}{j \cdot \omega \cdot \left[\sum_p \sum_q \frac{Y_{p,q}}{[(\omega m_{p,q})^2 - \omega^2] + 2j - \zeta \cdot \omega m_{p,q} \cdot \omega}\right]}$$

$$Zm(\omega, \alpha) = \frac{\mu \cdot \mathrm{Area}}{j \cdot \alpha \cdot \left[\sum_p \sum_q \frac{Y_{p,q}}{\left[\frac{B}{\mu}\left[\frac{(\lambda_p)^2}{\alpha \cdot \mathrm{Area}} + \omega \cdot \frac{(\lambda_q)^2}{\mathrm{Area}}\right]^2 - \omega^2\right] + 2j \cdot \zeta \cdot \omega^2}\right]} \quad \text{approx}$$

$$Zm(\omega, \alpha) = \frac{8 \cdot \sqrt{B \cdot \mu}}{j \cdot \frac{\omega}{\omega c} \cdot \left[\sum_p \sum_q \frac{8 \cdot Y_{p,q}}{\left[\frac{(\lambda_p)^2}{\alpha} + \alpha \cdot (\lambda_q)^2\right]^2 - (1 - 2j \cdot \xi) \cdot \left(\frac{\omega}{\omega c}\right)^2}\right]}$$

define $$Ym(x, \alpha) = \frac{8 \cdot \sqrt{B \cdot \mu}}{Zm(x\ \omega c, \alpha)}$$

$$Ym(x, \alpha) := j - x \cdot \left[\sum_p \sum_q \frac{8 \cdot Y_{p,q}}{\left[\frac{(\lambda_p)^2}{\alpha} + \alpha \cdot (\lambda_q)^2\right]^2 - (1 - 2j \cdot \xi) \cdot x^2}\right]$$

Turning to alternative analysis and design methodology specifically using inherently fully two-dimensional plate vibration equations, there is self-evident possibility of taking account of more up to all possible modes of bending wave related vibration in panels. This, of course raises the matter of assessing which up to given set of circumstances.

However, first application of such methodology gives rise to substantially free-edge rectangular panel aspect ratios precisely calculated at 1.134, 1.227, 1.320 and 1.442 together with likewise calculated "best" transducer location co-ordinates (0.359, 0.459), (0.414, 0.424), (0.381, 0.429) and (0.409, 0.459), respectively. For substantially rectangular clamped edge panels, precisely calculated aspect ratios (1.155, 1.299, 1.309, 1.5, 1.602 arise together with transducer location co-ordinates (0.446, 0.407), (0.391, 0.374), (0.281, 0.439), (0.347, 0.388) and (0.299, 0.488), respectively.

Both of closeness and differences as compared with above orthogonal two-beam simplified methodology are of interest and subject of further investigation.

Figure 17A:
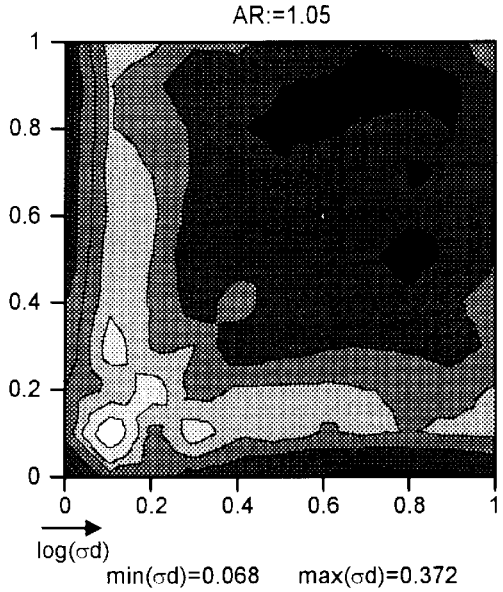
FIGS. 17A–T are quarter-panel contour plots of mechanical impedance obtained by full two-dimensional analysis/methodology.
Figure 17B:
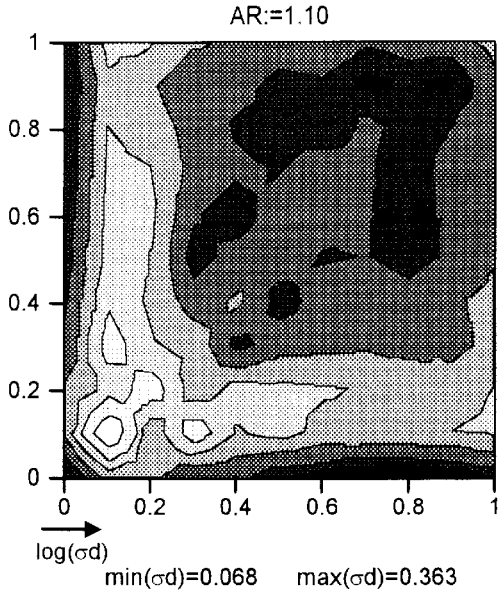
Figure 17C:
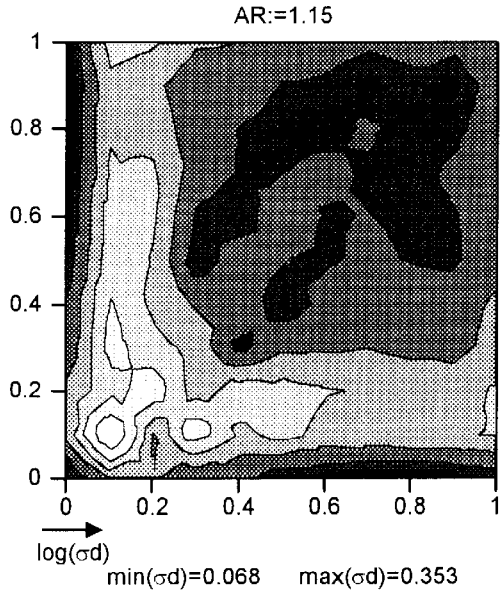
Figure 17D:
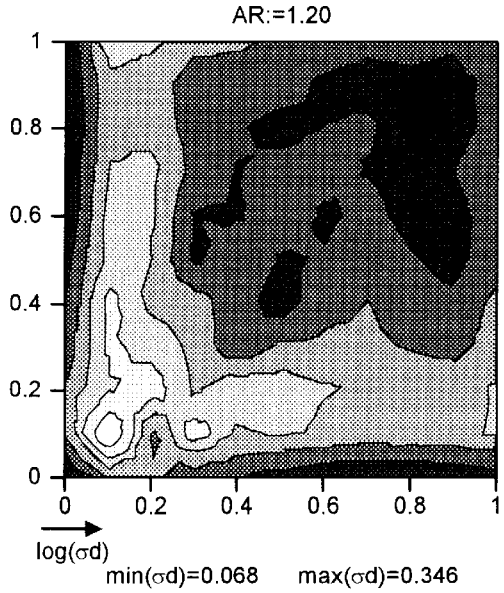
Figure 17E:
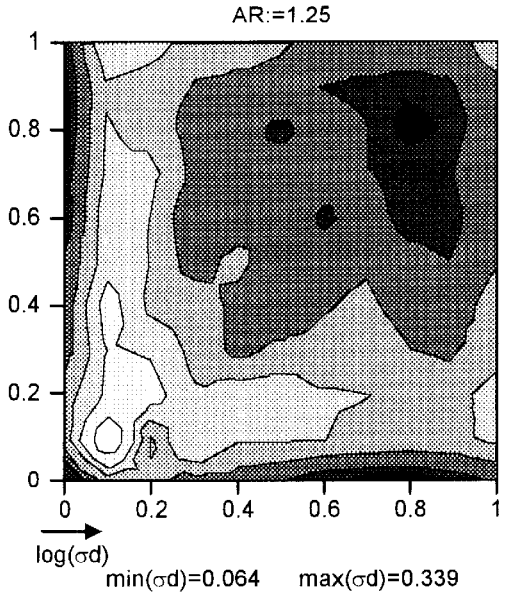
Figure 17F:
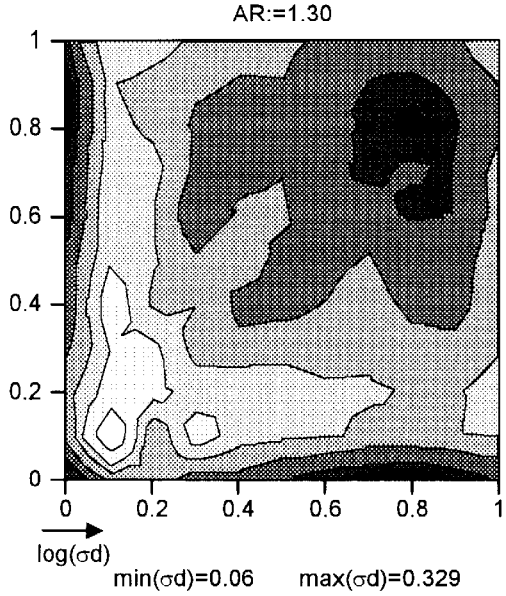
Figure 17G:
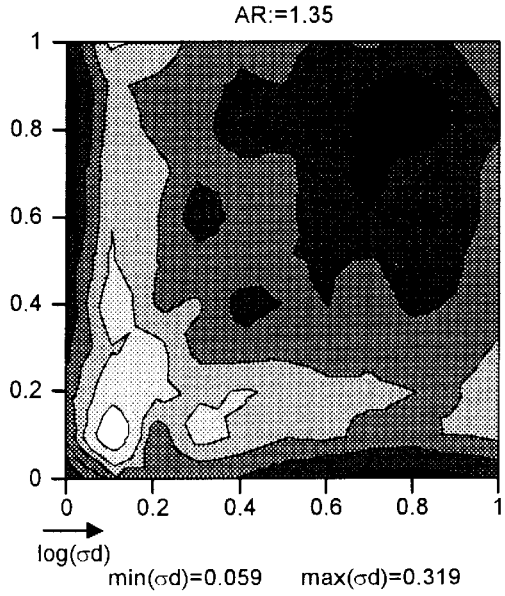
Figure 17H:
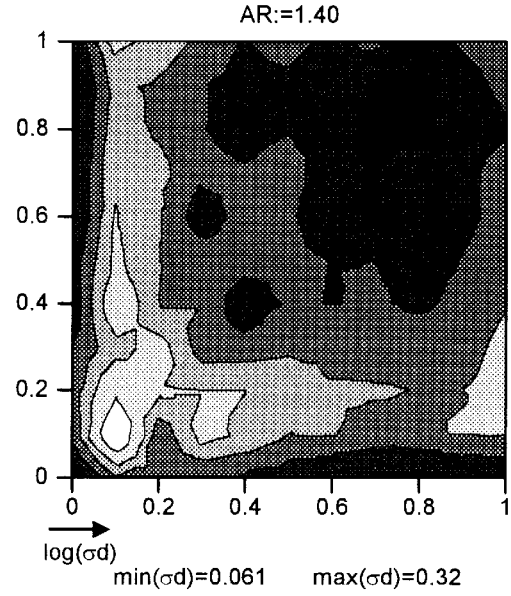
Figure 17I:
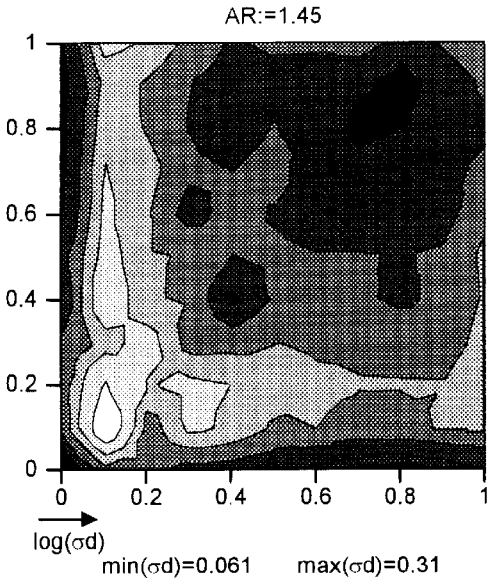
Figure 17J:
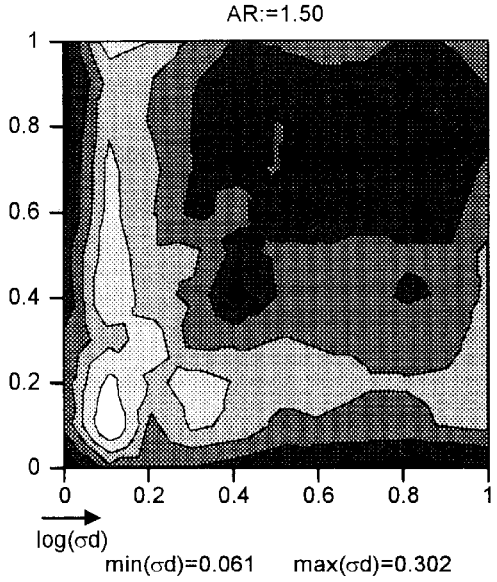
Figure 17K:
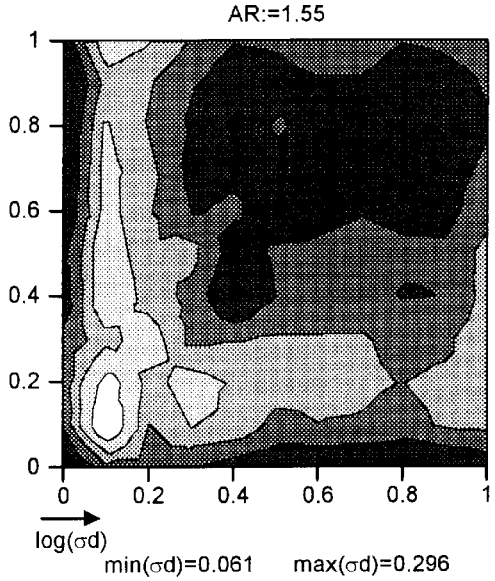
Figure 17L:
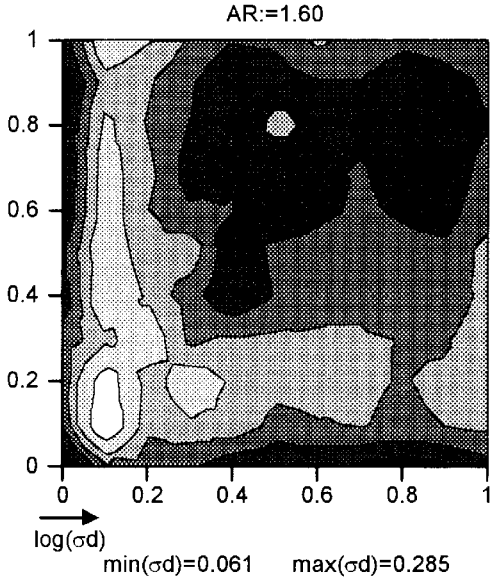
Figure 17M:
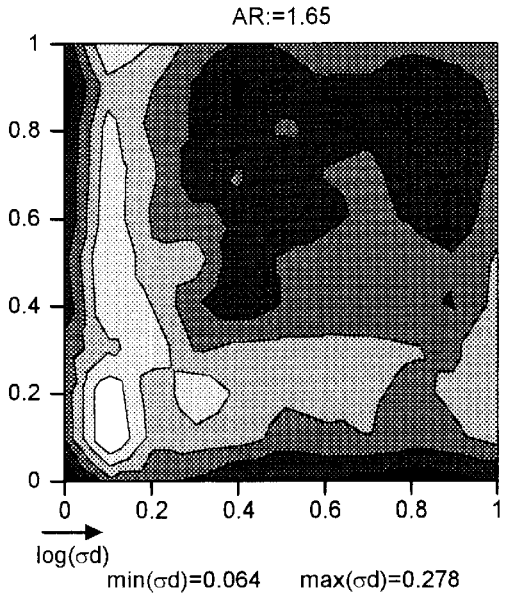
Figure 17N:
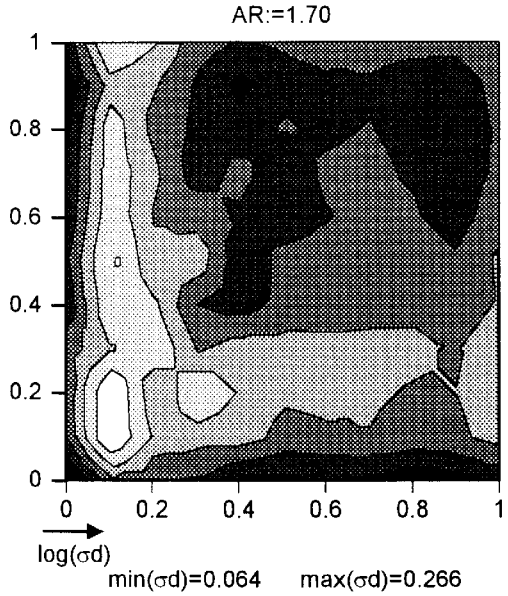
Figure 17O:
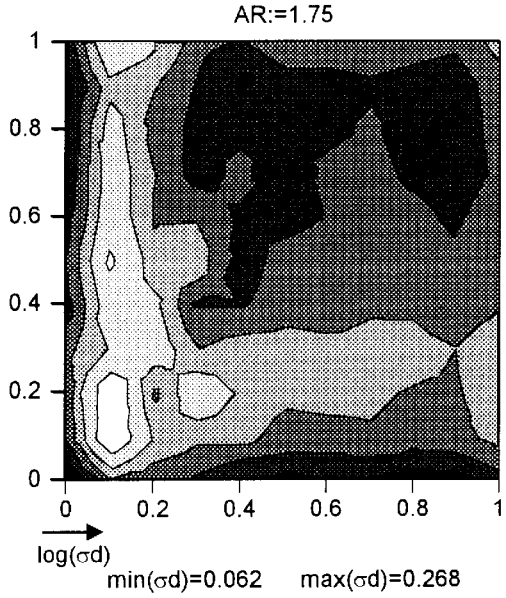
Figure 17P:
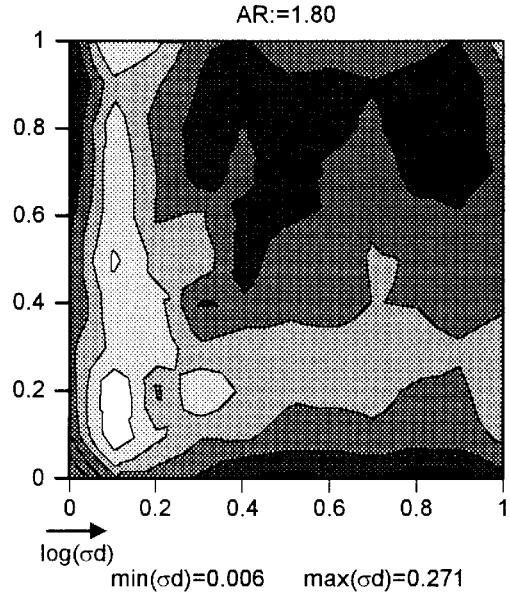
Figure 17Q:
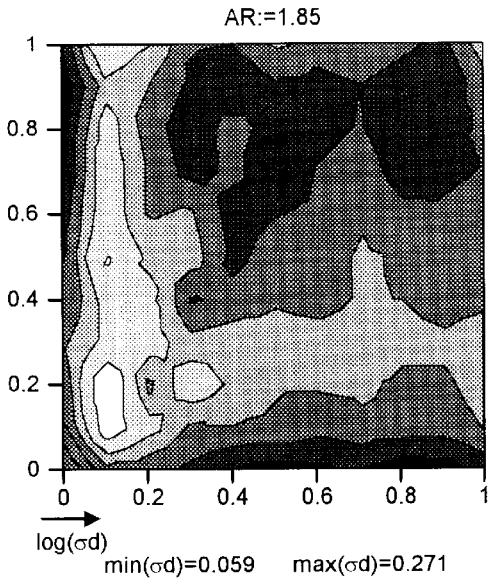
Figure 17R:
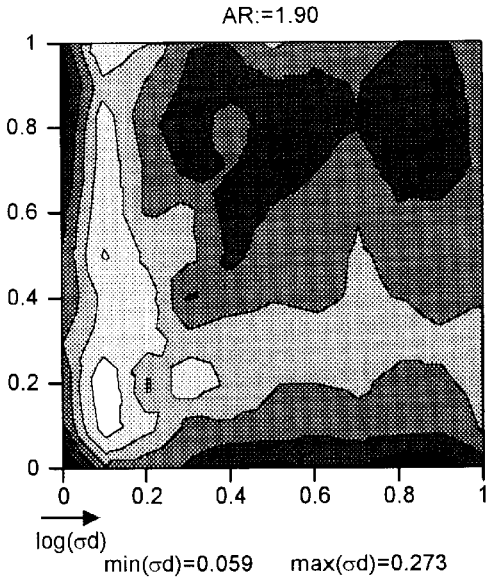
Figure 17S:
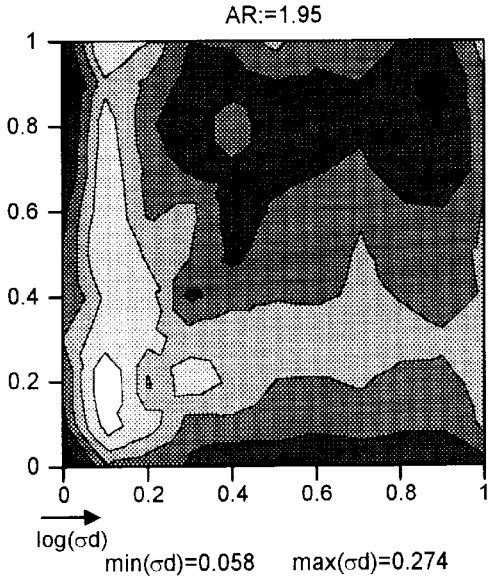
Figure 17T:
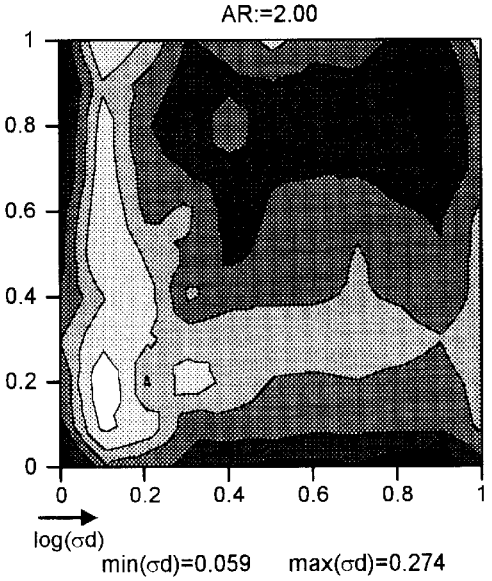

Reverting to analysis of panels of any aspect ratios, fully two-dimensional analysis and methodology has been applied over a wide range, specifically from 1.05 to 2.00 in steps of 0.05. Results are shown as quarter-panel plots of mechanical impedance in FIGS. 17A–T, in each case by proportionate contouring with worst and best indicated by hatching and cross-hatching, respectively, and with lightest coalesced from original 14-level scaling. Whilst this means that each plot is individual, it is found to be useful to know the darkest and near darkest locations in areal terms at about 7% intervals, though other presentation and analysis will be useful, whether as to levels and intervals as such or even as to relationships with minimum areas reasonably required for transducer coupling or with absolute levels related to transducer performance, etc.

Figure 18:
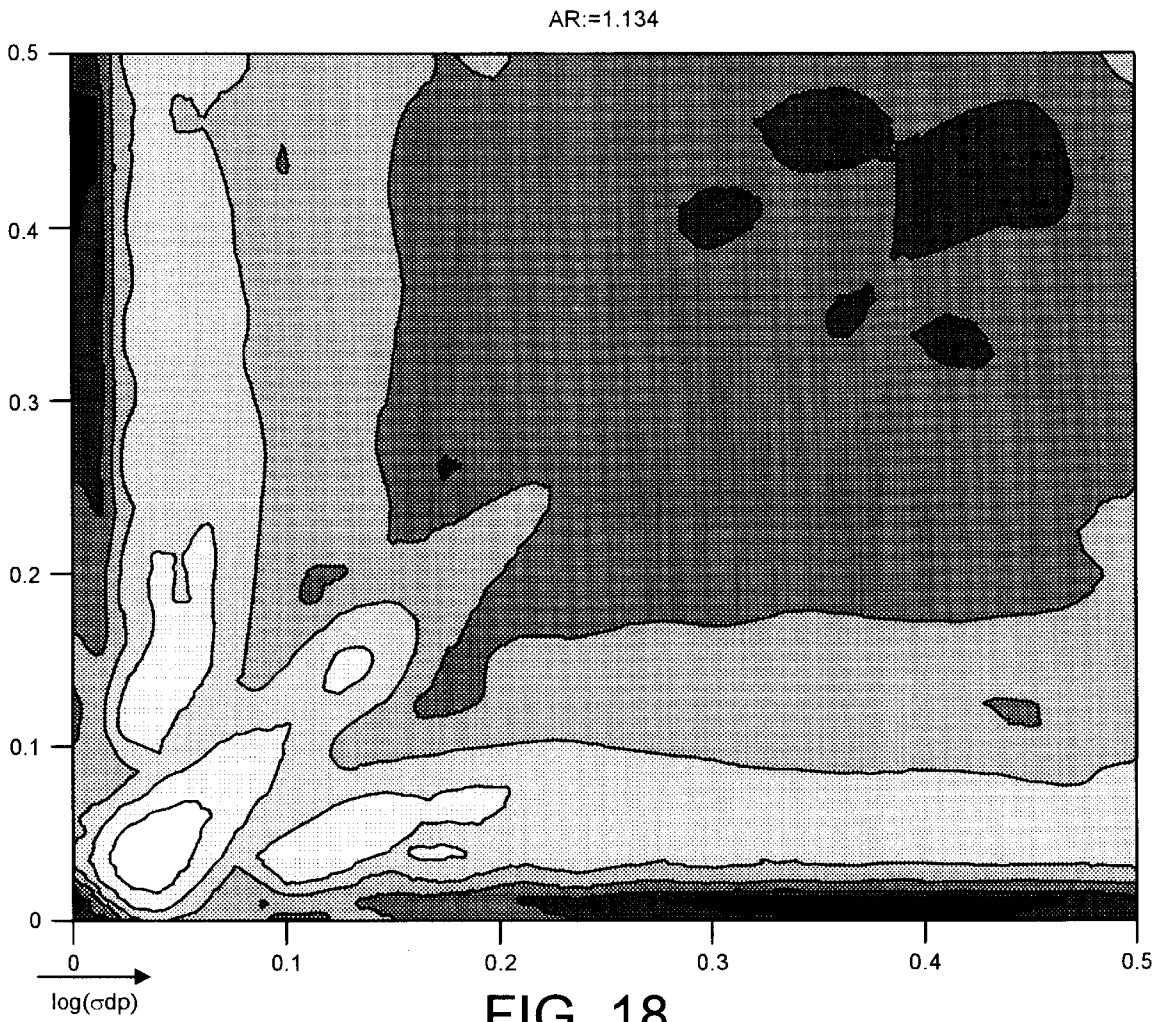
FIG. 18 is a larger scale quarter-panel contour plot of mechanical impedance for longest known favourable aspect ratio 1.134.

A larger scale areal plot on a six-level grey scale contour basis is given in FIG. 18 for one of the original preferential aspect ratios, specifically 1.134, and the distribution of worst locations (lightest) is interestingly mostly in accord with previous thinking, namely close to, but not actually at, each corner. However, possibility of true or near-true point energisation could well be attractive if precisely on a corner itself, perhaps even on a localised extension for practical sizes of transducer, and if smoothness of power transfer out-weighed inevitable reduction of efficiency of power transfer. Extension of the worst locations in lobes away from the corner at quite acute angles to the sides is seen as noteworthy. Concentration of lowest mechanical impedance (darkest) at long-known well in-board but eccentric locations is also of interest, including separation into discrete sub-areas, though perhaps particularly extent of next-darkest region to splitting intrusion from a virtually diagonal lobe of more variable mechanical impedance from the worst near-corner location. Edge-adjacent location of strips of low to lowest mechanical impedance deviation is in accordance with what we had found empirically, namely including favouring positions correlating well with co-ordinates of in-board sub-areas of least mechanical impedance deviation and longest known preferential location 25 for transducers.

Figure 19:
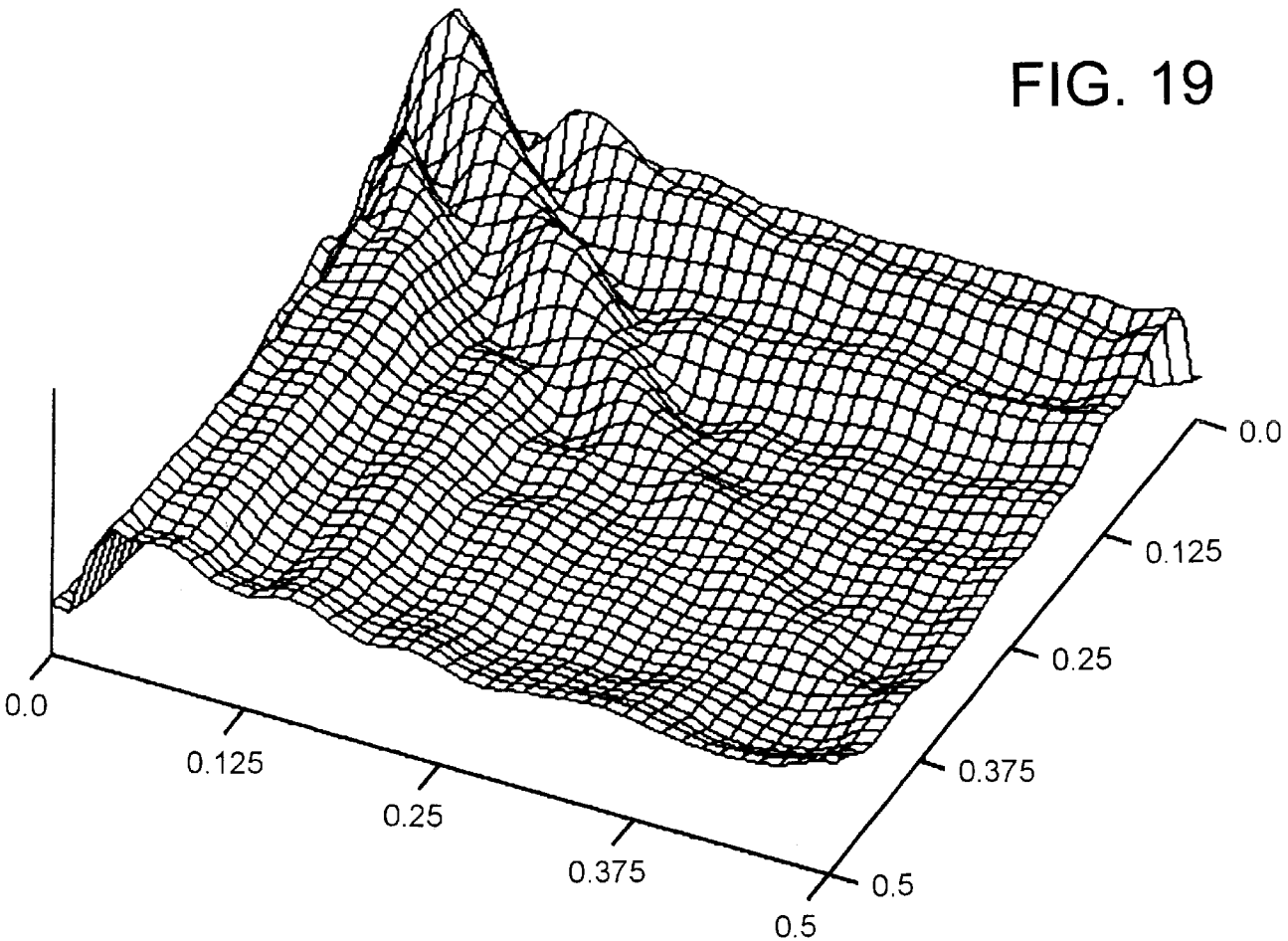
FIG. 19 is a corresponding three-dimensional plot.

FIG. 19 is essentially another representation of what is shown in FIG. 18, but usefully in effectively continuous three dimensional format in accordance with mechanical impedance.

Example is now given of two-dimensional analysis and of methodology along the lines of the previous example for two-beam simplified techniques.

EXAMPLE II

Panel data:

| | |
|---|---|
| $E_x$, $V_x$ | Young's modulus and Poisson's ratio of panel material along the $x$-axis |
| $E_Y$ $V_Y$ | Young's modulus and Poisson's ratio of panel material along the $y$-axis |
| $G_{XY}$ | In – plane shear modulus of panel material |
| $\rho$ | Density of panel material |
| $L_X$, $L_Y$ | Panel length along the $x$-and $y$-axis directions respectively |
| $h$ | Panel thickness |

Constants:

$$D_x = \frac{E_x \cdot h^3}{12\sqrt{1 - v_x \cdot v_y}} \qquad D_y = \frac{E_y \cdot h^3}{12\sqrt{1 - v_x \cdot v_y}} \qquad D_k = \frac{G_{xy} \cdot h^3}{12}$$

$$D_{xy} = D_x \cdot v_y + 2 \cdot D_k \qquad \mu = \rho h \qquad \alpha = \frac{1}{Lx \cdot Ly} \cdot \sqrt{\frac{D_{xy}}{\mu}} \qquad r = \frac{Lx}{Ly}$$

Modal frequency expression:

$$f = \frac{\alpha}{2 \cdot \pi} \cdot \sqrt{\begin{array}{c} D_x \cdot \left(\frac{\lambda_x}{\sqrt{r}}\right)^4 + D_y \cdot \left(\sqrt{r} \cdot \lambda_y\right)^4 + 2 \cdot D_{xy} \cdot \lambda_x \cdot \lambda_y \cdot \\ (\lambda_x - \beta_x) \cdot (\lambda_y - \beta_y) - +4 \cdot D_k \cdot \lambda_x \cdot \lambda_y \cdot \\ [(\lambda_x - \beta_x) \cdot (\lambda_y - \beta_y) - (\lambda_x - \gamma_x) \cdot (\lambda_y - \gamma_y)] \end{array}}$$

where $\lambda_x$, $\lambda_y$ are the relevant (boundary-condition dependent) beam eigenvalues in the x- and y-directions respectively and $\beta_x, \delta_y, \gamma_x, \gamma_x$ are corresponding constants As an example, for a fully free panel $\beta_x = \beta_y = -6$ $\gamma_x = \gamma_y = 2$ $\lambda_x = \lambda_y = \lambda$ where $\cosh(\lambda) \cdot \cos(\lambda) = 1$

Mode Shape Expression $$\phi = c1 + c2 \cdot \zeta + c3 \cdot \cos h(\lambda \cdot \zeta) + c4 \cdot \sin h(\lambda \cdot \zeta) + c5 \cdot \cos(\lambda \cdot \zeta) + c6 \cdot \sin(\lambda \cdot \zeta)$$

where c1 . . . c6 are boundary-condition and mode-dependent beam function constants As an example, for the 1st flexural mode of a fully free beam c1=c2=0 c3=c5=10 c4=c6=0 982502215

Relative Mobility Expression

The mobility of the finite panel relative to that of an infinite panel ($8\sqrt{D_{xy}\mu}$) at a specific point on the panel is given by $$\psi = 1\frac{4 \cdot \alpha}{\pi} \sum_j \frac{\Phi_j}{[(f_j)^2 - F^2] + 1[\delta_s (f_j)^2 + 2 \cdot \delta_v \cdot (F \cdot f_j)]}$$

where F is the driving frequency and $\delta_s, \delta_v$ are the structural and viscous damping factors for the panel material respectively and $\Phi = (\phi_x)^2 (\phi_y)^2$ Being a function of driving frequency, the relative mobility for any point is sampled at 'j' discrete frequencies in the frequency range of interest, the mean of which is given by $$\psi_{av} = \frac{1}{2 \cdot (F_{\max} - F_{\min})} \cdot \sum_j \Delta F_j \cdot (\psi_j + \psi_{j+1})$$

$\Delta F_j = F_{j+1} - F_j$

Measure of Goodness

A logarithmic measure of the variation of relative mobility (with the mean removed) is used for optimisation purposes, i e $$\aleph = \log\left(\frac{\psi}{\psi_{av}}\right)$$

The standard deviation of this measure is used for identifying optimum drive locations $$\sigma = \sqrt{\frac{1}{2(F_{\max} - F_{\min}} \sum_j \Delta F_j [(x_j)^2 + (x_{j+1})^2]}$$

Precision of values given above for aspect ratios and/or co-ordinate transducer locations is an inevitable result of calculation, and not necessarily indication of more than some point within a range of viability For transducer locations areal plots are particularly promising, certainly affording deserving basis for investigation by experimentation both as to matching between results of analytical methodology as proposed herein and as to actual acoustic performance for which number of resonant modes coupled is important as is reasonable evenness of couplings to as many modes as practical. Ready availability of analysis for any aspect ratios and refinement thereof relative to particular transducer locations and own refinement capability can be useful in revealing greater generality of application of some especially favourable transducer locations/areas as well as particularity to aspect ratios of other transducer locations/areas.

It is believed to be of particularly high potential to have arrived at a single discipline or demonstrator of merit, termed herein measure of smoothness of mechanical impedance, that is equally capable of locating and specifying both valuable aspect ratios and transducer locations, including evident capability for recursive refinement, i.e. essentially jointly choosing geometry and transducer location by similar procedures using essentially the same variable or parameter, or feasible variations thereon.

What is claimed is:

1. A method of making an acoustic device relying on bending wave action in an area of a panel member, the method comprising:

selecting a physical parameter to be varied, the physical parameter being selected from the group consisting of configuration/geometry of said area of the panel member, the bending stiffness of said area of the panel member, and the location of a bending wave transducer in said area of said panel member, selecting a power transfer related parameter of said panel member, the power transfer related parameter being a function of at least one of the physical parameters and being selected from the group consisting of input power transfer, mechanical impedance and power output, varying the physical parameter and analytically assessing a measure of the power transfer related parameter, as a function of the physical parameter, selecting the value of the physical parameter which provides a minimum or minima of deviation of the power transfer related parameter whereby smoothness of the power transfer and hence satisfactory acoustic device performance over a desired frequency range is achieved.

2. Method according to claim 1, including compensating for deviation from flatness of output power by correlated conditioning of the input to the acoustic device.

3. Method according to claim 1, wherein analytically assessing a measure of the power transfer related parameter includes determining the standard deviation of said power transfer related function.

4. Method according to claim 3, wherein said panel member is substantially rectangular, and analytically assessing a measure of the power transfer related parameter includes determining a two-dimensional simplification of the distribution of resonant frequency modes to orthogonal beams in directions parallel to pairs of opposite sides of said panel member.

5. A method according to claim 3, wherein the panel has a distribution of resonant frequency modes.

6. Method according to claim 5, wherein said standard deviation is determined by applying a unity weighting to contributions from each resonant frequency mode.

7. Method according to claim 5, wherein said deviation is determined by calculating a mean value for contributions from each resonant frequency mode.

8. Method according to claim 5, wherein said deviation is determined by applying a selective weighting to contributions from each resonant frequency mode.

9. Method according to claim 8, wherein the acoustic device has an operational frequency range of interest and said selective weighting is applied to resonant frequency mode(s) at each extremity of the operational frequency range of interest.

10. Method according to claim 9, wherein selective weighting is applied to resonant frequency mode(s) which are lowest in the operational frequency range of interest.

11. Method according to claim 8, claim 9, or claim 10, wherein analytically assessing a measure of the power transfer related parameter includes determining a one-dimensional simplification of the distribution of resonant frequency modes.

12. Method according to claim 1, wherein said power transfer related parameter is mechanical impedance.

13. Method according to claim 1, wherein the physical parameter of configuration/geometry of said area of the panel member includes proportions of physical of said panel member.

14. Method according to claim 1, wherein analytically assessing a measure of the power transfer related parameter includes graphically presenting smoothed mechanical impedance of said panel member against said varied physical parameter to show minima of deviation.

15. Method according to claim 13 or claim 14, wherein analytically assessing a measure of the power transfer related parameter is for given transducer location(s).

16. Method according to claim 13, including the step of selecting panel member physical proportion and the step of selecting transducer location, wherein one of the two said steps of selecting is done at least once after and using results of doing the other said step.

17. Method according to claim 1, wherein analytically assessing a measure of the power transfer related parameter is for one varying physical parameter, the other physical parameters remaining fixed and presenting results graphically, in looking for minimum deviation of smoothed mechanical impedance.

18. Method according to claim 17, including alternating which physical parameter is fixed and which is varying.

19. Method according to claim 1, wherein analytically assessing a measure of the power transfer related parameter includes presenting an areal map of the distribution of mechanical impedance of said panel member.

20. Method according to claim 19, wherein said areal map is a contour mapping of areal deviation of mechanical impedance.

21. Method according to claim 20, wherein said analytical assessment and contour mapping is of one quadrant for a substantially rectangular physical of said panel member.

* * * * *